US010077932B2

(12) United States Patent
Yoon et al.

(10) Patent No.: US 10,077,932 B2
(45) Date of Patent: Sep. 18, 2018

(54) REFRIGERATOR

(71) Applicant: SAMSUNG ELECTRONICS CO., LTD., Suwon-si, Gyeonggi-do (KR)

(72) Inventors: Won-Jae Yoon, Seoul (KR); Yong Han Kim, Suwon-si (KR); Yoon Young Kim, Suwon-si (KR); Kook Jeong Seo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 119 days.

(21) Appl. No.: 15/067,413

(22) Filed: Mar. 11, 2016

(65) Prior Publication Data

US 2016/0265833 A1 Sep. 15, 2016

(30) Foreign Application Priority Data

Mar. 11, 2015 (KR) ..... 10-2015-0034074

(51) Int. Cl.
*F25B 41/00* (2006.01)
*F25D 11/02* (2006.01)
(Continued)

(52) U.S. Cl.
CPC ..... *F25D 11/022* (2013.01); *F25B 41/04* (2013.01); *F25D 29/00* (2013.01);
(Continued)

(58) Field of Classification Search
CPC .. F25D 11/022; F25D 29/00; F25D 2700/121; F25D 2600/04; F25B 41/04; F25B 2600/2511
See application file for complete search history.

(56) References Cited

U.S. PATENT DOCUMENTS

2007/0084238 A1 4/2007 Son et al.

FOREIGN PATENT DOCUMENTS

DE 10 2011 082 062 A1 3/2013
EP 0 583 905 A1 2/1994
(Continued)

OTHER PUBLICATIONS

Sakai et al., Refrigerator, Nov. 6, 2003, JP2003314945A, Whole Document.*

(Continued)

*Primary Examiner* — Larry Furdge
(74) *Attorney, Agent, or Firm* — Staas & Halsey LLP

(57) ABSTRACT

The present disclosure relates to a refrigerator having a first storage compartment, a second storage compartment, and a third storage compartment. The refrigerator includes a four-way valve including an inlet through which refrigerant is introduced, a plurality of outlets to discharge the refrigerant, and configured to open at least one of the plurality of outlets, a first heat exchanger connected to a first outlet of the plurality of outlets to adjust a temperature of the first storage compartment, a second heat exchanger connected to a second outlet of the plurality of outlets to adjust a temperature of the second storage compartment, and a third heat exchanger connected to the second heat exchanger and a third outlet of the plurality of outlets to receive refrigerant from at least one of the second heat exchanger and the third outlet to adjust a temperature of the third storage compartment.

20 Claims, 26 Drawing Sheets

(51) Int. Cl.
*F25B 41/04* (2006.01)
*F25D 29/00* (2006.01)

(52) U.S. Cl.
CPC ... *F25B 2600/2511* (2013.01); *F25D 2600/04* (2013.01); *F25D 2700/121* (2013.01)

(56) References Cited

FOREIGN PATENT DOCUMENTS

| | | | |
|---|---|---|---|
| JP | 2001-325651 | | 11/2001 |
| JP | 2002-81817 | | 3/2002 |
| JP | 2003-65619 | | 3/2003 |
| JP | 2003-207249 | | 7/2003 |
| JP | 2003-314945 | | 11/2003 |
| JP | 2003314945 A | * | 11/2003 |
| JP | 2004-28370 | | 1/2004 |
| JP | 2006-139450 | | 6/2006 |
| JP | 2007-101152 | | 4/2007 |
| JP | 2007-333299 | | 12/2007 |
| JP | 2010-139218 | | 6/2010 |
| JP | 2010139218 A | * | 6/2010 |
| KR | 10-2007-0094287 | | 9/2007 |
| KR | 10-2015-0017183 | | 2/2015 |

OTHER PUBLICATIONS

Yamashita, Refrigerator, Jun. 24, 2010, JP2010139218A, Whole Document.*

European Office Action dated Jun. 26, 2017, in corresponding European Patent Application No. 16 159 899.0.

European Intention to Grant dated Dec. 18, 2017, in corresponding European Patent Application No. 16 159 899.0.

Chinese Office Action dated Dec. 21, 2017, in corresponding Chinese Patent Application No. 201610140165.8.

Extended European Search Report dated Jul. 8, 2016 in corresponding European Patent Application No. 16159899.0.

* cited by examiner

REFRIGERATOR

CROSS-REFERENCE TO RELATED APPLICATION

This application claims the benefit of Korean Patent Application No. 2015-0034074, filed on Mar. 11, 2015 in the Korean Intellectual Property Office, the disclosure of which is incorporated herein by reference.

BACKGROUND

1. Field

The present disclosure relates to a refrigerator.

2. Description of the Related Art

A refrigerator is an apparatus capable of storing articles to be stored such as food and drugs at a temperature equal to or lower than a predetermined temperature, and is recently being variously used in households or industrial sites. The refrigerator includes a storage compartment to store articles to be stored and a cooling unit to supply cold air to the storage compartment in order to keep the storage compartment at a temperature equal to or lower than a predetermined temperature, thereby storing the articles to be stored at the temperature equal to or lower than a predetermined temperature.

The storage compartment of the refrigerator may include a refrigerator compartment, a freezer compartment, or an alternating-temperature compartment. The refrigerator compartment is cooled to a temperature equal to or lower than a predetermined temperature in order to refrigerate articles to be stored, and the freezer compartment is cooled to a temperature lower than that of the refrigerator compartment to freeze and store articles to be stored. The alternating-temperature compartment may vary a temperature therein depending on types or characteristics of articles to be stored to store and preserve various types of articles to be stored in accordance with the characteristics thereof.

The cooling unit may repeat a process of evaporating and compressing refrigerant through a cooling cycle to keep the temperature of the storage compartment at a level desired by a user. The cooling unit may include an evaporator, a compressor, a condenser, and a four-way expansion valve in order to cyclically repeat evaporation and compression of the refrigerant.

SUMMARY

It is an aspect of the present disclosure to provide a refrigerator capable of effectively performing independent cooling of at least one storage compartment in a refrigerator including a plurality of storage compartments.

It is another aspect of the present disclosure to provide a refrigerator in which parts required for cooling are reduced or integrated to improve a structure required for a cooling cycle, thereby reducing a manufacturing cost of the refrigerator including a plurality of storage compartments.

It is still another aspect of the present disclosure to provide a refrigerator in which a relatively low-capacity compressor is used, thereby not only easily dealing with an overload but also improving energy efficiency in the refrigerator including a plurality of storage compartments.

To achieve the above aspects, a refrigerator is provided.

A refrigerator having a first storage compartment, a second storage compartment, and a third storage compartment includes a four-way valve, a first heat exchanger, a second heat exchanger and a third heat exchanger. The four-way value includes an inlet through which refrigerant is introduced and a plurality of outlets to discharge the refrigerant, and is configured to open at least one of the plurality of outlets. The first heat exchanger is connected to a first outlet of the plurality of outlets to adjust a temperature of the first storage compartment. The second heat exchanger is connected to a second outlet of the plurality of outlets to adjust a temperature of the second storage compartment. The third heat exchanger is connected to the second heat exchanger and a third outlet of the plurality of outlets to receive refrigerant from at least one of the second heat exchanger and the third outlet to adjust a temperature of the third storage compartment.

A temperature of at least one of the first storage compartment, the second storage compartment, and the third storage compartment may be independently adjusted.

The first heat exchanger and the second heat exchanger may be connected to each other in parallel.

The second heat exchanger and the third heat exchanger may be serially connected to each other.

The third heat exchanger may be further connected to the first heat exchanger and receive refrigerant from at least one of the first heat exchanger, the second heat exchanger, and the third outlet to adjust the temperature of the third storage compartment.

At least one of the first storage compartment, the second storage compartment, and the third storage compartment may include an alternating-temperature compartment in which a temperature is adjustable within a predetermined range.

At least one of the first storage compartment, the second storage compartment, and the third storage compartment may include at least one of a refrigerator compartment in which a temperature is adjusted in accordance with a predetermined set temperature and a freezer compartment in which a temperature is adjusted to be lower than a temperature of the refrigerator compartment.

The first storage compartment may be the refrigerator compartment, the second storage compartment may be the alternating-temperature compartment, and the third storage compartment may be the freezer compartment.

The first storage compartment may be the freezer compartment, the second storage compartment may be the refrigerator compartment, and the third storage compartment may be the alternating-temperature compartment.

The first storage compartment may be the alternating-temperature compartment, the second storage compartment may be the refrigerator compartment, and the third storage compartment may be the freezer compartment.

The refrigerator may further include a control unit to control the first outlet of the four-way valve to be opened to transfer refrigerant to the first heat exchanger, control the second outlet of the four-way valve to be opened to transfer refrigerant to the second heat exchanger and the third heat exchanger connected to the second heat exchanger, or control the third outlet of the four-way valve to be opened to transfer refrigerant to the third heat exchanger.

The refrigerator may further include a storage compartment temperature measurement unit to measure an air temperature of an inner portion of at least one storage compartment of the first storage compartment, the second storage compartment, and the third storage compartment.

The control unit may open at least one of the first outlet, the second outlet, and the third outlet in accordance with a temperature of at least one storage compartment of the first storage compartment, the second storage compartment, and the third storage compartment received from the storage compartment temperature measurement unit.

The control unit may open the first outlet and control the first outlet to be closed and the second outlet to be opened when the temperature of the first storage compartment has reached a set temperature.

The control unit may open at least one of the first outlet, the second outlet, and the third outlet in accordance with time elapsed.

The control unit may control the first outlet, the second outlet, and the third outlet to be opened sequentially.

The control unit may control at least two of the first outlet, the second outlet, and the third outlet to be opened alternately to adjust inner temperatures of the storage compartments corresponding to the at least two outlets.

Among the first storage compartment, the second storage compartment, and the third storage compartment, at least one may be the refrigerator compartment, another one may be the freezer compartment, and the remaining one may be the alternating-temperature compartment. In this case, the control unit may open an outlet connected to the refrigerator compartment, and alternately open an outlet connected to the freezer compartment and an outlet connected to the alternating-temperature compartment when the outlet connected to the refrigerator compartment is closed.

The refrigerator may further include one compressor to suction and discharge refrigerant discharged from at least one of the first heat exchanger, the second heat exchanger, and the third heat exchanger, and a condenser to liquefy the refrigerant discharged from the compressor to supply the refrigerant to the four-way valve.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, a refrigerator according to an embodiment will be described with reference to FIG. 1.

Figure 1:
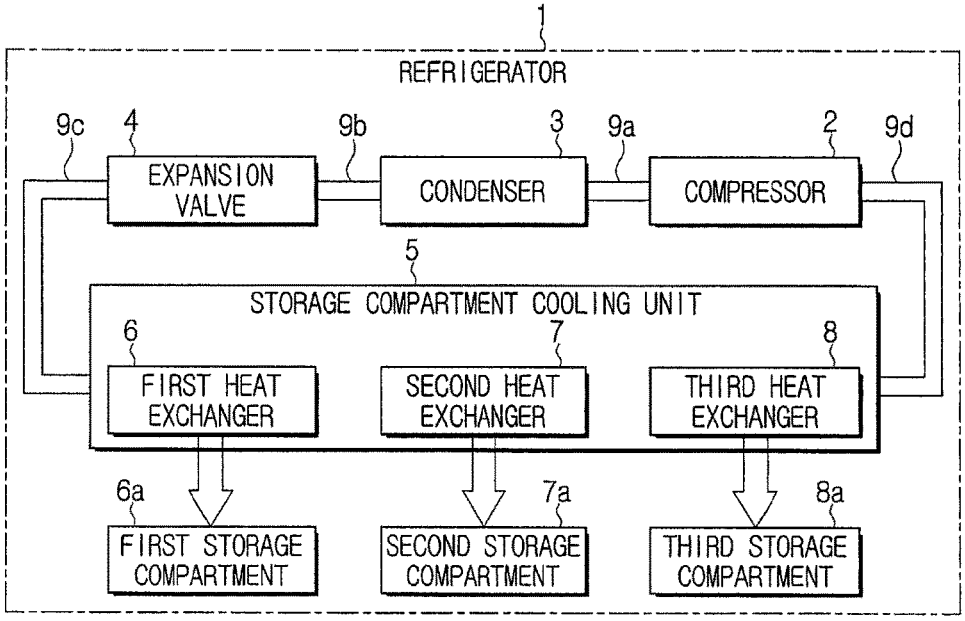
FIG. 1 is a view illustrating a cooling cycle structure of a refrigerator according to an embodiment.

FIG. 1 is a view illustrating a cooling cycle structure of a refrigerator according to an embodiment. In FIG. 1, an arrow illustrated in each of refrigerant passages 9*a* to 9*d* represent a flow direction of refrigerant when a cooling cycle is performed within a refrigerator 1.

Referring to FIG. 1, the refrigerator 1 may include a compressor 2, a condenser 3, an expansion valve 4, a storage compartment cooling unit 5, and the refrigerant passages 9*a* to 9*d* to connect the compressor 2, the condenser 3, the expansion valve 4, and the storage compartment cooling unit 5.

The compressor 2 may forcibly suction refrigerant and compress the suctioned refrigerant to convert the refrigerant to high-pressure gas, and the suctioning of the refrigerant may be performed using a rotary force of an embedded motor. The refrigerant may be circulated within the cooling cycle of the refrigerator 1 by a force of the compressor 2 suctioning the refrigerant. Consequently, a circulation amount or a circulation speed of the refrigerant may be determined in accordance with an extent to which the compressor 2 operates, and furthermore, cooling efficiency of the refrigerator may be determined. The compressor 2 may be realized using an inlet through which refrigerant is introduced, a flowing space in which the introduced refrigerant flows, a motor rotating within the flowing space and parts related to the motor, and an outlet through which the suctioned refrigerant is discharged. The inlet of the compressor 2 is connected to the refrigerant passage 9*d* to which the refrigerant is supplied to transfer the refrigerant. Accordingly, the compressor 2 may receive refrigerant evaporated due to heat absorbed in the storage compartment cooling unit 5 through the refrigerant passage 9*d*.

Freon (chlorofluorocarbon (CFC)), hydrochlorofluorocarbon (HCFC), or hydrofluorocarbon (HFC), etc. may be employed as the refrigerant transferred to the compressor 2 through the refrigerant passage 9*d*. However, the refrigerant is not limited thereto, and various types of substances that may be selected by a designer may be employed as the refrigerant.

In accordance with embodiments, a volumetric compressor or a dynamic compressor, etc. may be employed as the compressor 2. According to an embodiment, the refrigerator 1 may include only one compressor 2.

The high-temperature, high-pressure gaseous refrigerant compressed in the compressor 2 may be transferred to the condenser 3. For this, the refrigerant passage 9*a* may be provided between the compressor 2 and the condenser 3, and the high-temperature, high-pressure gaseous refrigerant acquired by the compressor 2 may be transferred to the condenser 3 through the refrigerant passage 9*a*.

The condenser 3 may liquefy the high-temperature, high-pressure gaseous refrigerant received from the compressor 2 to acquire high-temperature, high-pressure liquid. The refrigerant emits heat to the outside while being liquefied in the condenser 3 such that the temperature of the refrigerant is lowered. The refrigerant condensed in the condenser 3 may move to the expansion valve 4 through the refrigerant passage 9*b* that connects the condenser 3 to the expansion valve 4.

In accordance with embodiments, the condenser 3 may be realized using a pipe formed to be bent in a zigzag shape, and in this case, one end of the pipe may extend from the refrigerant passage 9*a* connected to the compressor 2 and the other end thereof may extend from the refrigerant passage 9*b* connected to the expansion valve 4.

The expansion valve 4 may expand the high-temperature, high-pressure liquefied refrigerant to discharge refrigerant in which low-temperature, low-pressure gas and liquid are mixed. Also, the expansion valve 4 may also adjust the amount of refrigerant introduced into the storage compartment cooling unit 5 in accordance with control. The refrigerant discharged from the expansion valve 4 may pass through the refrigerant passage 9*c* and be transferred to the storage compartment cooling unit 5.

According to an embodiment, the expansion valve 4 may include various types of valves such as a thermoelectric electronic expansion valve using deformation of a bimetal, a thermodynamic electronic expansion valve using cubical expansion by heating filled wax, a pulse width modulation type electronic expansion valve in which a solenoid valve is opened and closed by a pulse signal, and a step motor type electronic expansion valve in which a valve is opened and closed using a motor.

In accordance with embodiments, a capillary tube may be used instead of the expansion valve 4. The capillary tube may be realized by a thin tube, and the pressure of the refrigerant that has passed through the capillary tube is lowered to enter the storage compartment cooling unit 5.

The storage compartment cooling unit 5 may include a plurality of heat exchangers, e.g. a first heat exchanger 6, a second heat exchanger 7, and a third heat exchanger 8, and each of the heat exchangers 6 to 8 may adjust a temperature of an inner portion of a corresponding storage compartment, e.g. a first storage compartment 6*a*, a second storage compartment 7*a*, and a third storage compartment 8*a*.

Although an example in which the storage compartment cooling unit 5 includes one first heat exchanger 6, one second heat exchanger 7, and one third heat exchanger 8 is illustrated in FIG. 1, the storage compartment cooling unit 5 may include a plurality of first heat exchangers 6, may include a plurality of second heat exchangers 7, and may include a plurality of third heat exchangers 8 in accordance with embodiments.

A temperature rises within the first heat exchanger 6, the second heat exchanger 7, and the third heat exchanger 8 as the refrigerant that has been expanded by passing through the expansion valve 4 absorbs external latent heat, whereas temperatures of the surroundings of the first heat exchanger 6, the second heat exchanger 7, and the third heat exchanger 8 are lowered. Consequently, the first heat exchanger 6, the second heat exchanger 7, and the third heat exchanger 8 supply cold air to the surroundings. The cold air supplied from the first heat exchanger 6, the second heat exchanger 7, and the third heat exchanger 8 is transferred to inner spaces of the first storage compartment 6*a*, the second storage compartment 7*a*, and the third storage compartment 8*a* to cool the inner spaces of the first storage compartment 6*a*, the second storage compartment 7*a*, and the third storage compartment 8*a*. In this case, the cold air may also move to the inner spaces of the first storage compartment 6*a*, the second storage compartment 7*a*, and the third storage compartment 8*a* in accordance with an operation of a blower fan.

According to an embodiment, all of the first heat exchanger 6, the second heat exchanger 7, and the third heat exchanger 8 may operate independently of each other or at least one heat exchanger of the first heat exchanger 6, the second heat exchanger 7, and the third heat exchanger 8 may operate independently of another heat exchanger, and accordingly, at least one storage compartment of the first storage compartment 6*a*, the second storage compartment 7*a*, and the third storage compartment 8*a* may be cooled independently of another storage compartment.

Various types of articles to be stored that are stored at a temperature equal to or lower than a predetermined temperature such as food or drugs may be stored in the first storage compartment 6*a* to the third storage compartment 8*a*.

At least one of the first storage compartment 6*a* to the third storage compartment 8*a* may be a refrigerator compartment. The refrigerator compartment refers to a storage compartment in which an inner temperature is maintained at a temperature equal to or lower than a predetermined set temperature, and in this case, the set temperature may be a value between 0° C. to 7° C., for example. The set temperature may be changed by a user. The first heat exchanger 6 emits a greater amount of air into the first storage compartment 6*a* when the set temperature is lowered by the user, and the first heat exchanger 6 emits a smaller amount of air into the first storage compartment 6*a* when the set temperature is raised by the user.

At least one of the first storage compartment 6*a* to the third storage compartment 8*a* may be a freezer compartment. The freezer compartment may be set to a temperature lower than the set temperature of the refrigerator compartment to freeze and store articles to be stored. A set temperature of the freezer compartment may be equal to or less than 0° C. and may be various values from 0° C. to −30° C. in accordance with a user's choice. In accordance with embodiments, the set temperature of the freezer compartment may be even lower than the above.

At least one of the first storage compartment 6*a* to the third storage compartment 8*a* may be an alternating-temperature compartment. The alternating-temperature compartment refers to a storage compartment in which an inner space may be cooled to a predetermined set temperature depending on conditions, and the predetermined set temperature may include, for example, a temperature set in accordance with a type of an article to be stored. The set temperature may be changed within a predetermined range according to a user's choice. In accordance with embodiments, an inner temperature of the alternating-temperature compartment may be set to be a value between the inner temperature of the refrigerator compartment and the inner temperature of the freezer compartment.

The refrigerant that has been evaporated by absorbing latent heat while passing through the first heat exchanger 6, the second heat exchanger 7, and the third heat exchanger 8 of the storage compartment cooling unit 5 is transferred to the compressor 2 through the refrigerant passage 9*d*, and the refrigerant transferred to the compressor 2 is repeatedly compressed, condensed, and evaporated as mentioned above to cool the first storage compartment 6*a* to the third storage compartment 8*a*.

Hereinafter, an exterior and an inner structure of a refrigerator 10 according to an embodiment to which the above-mentioned compressor 2, condenser 3, expansion valve 4, and storage compartment cooling unit 5 are applied will be described with reference to FIGS. 2 to 9E.

Figure 2:
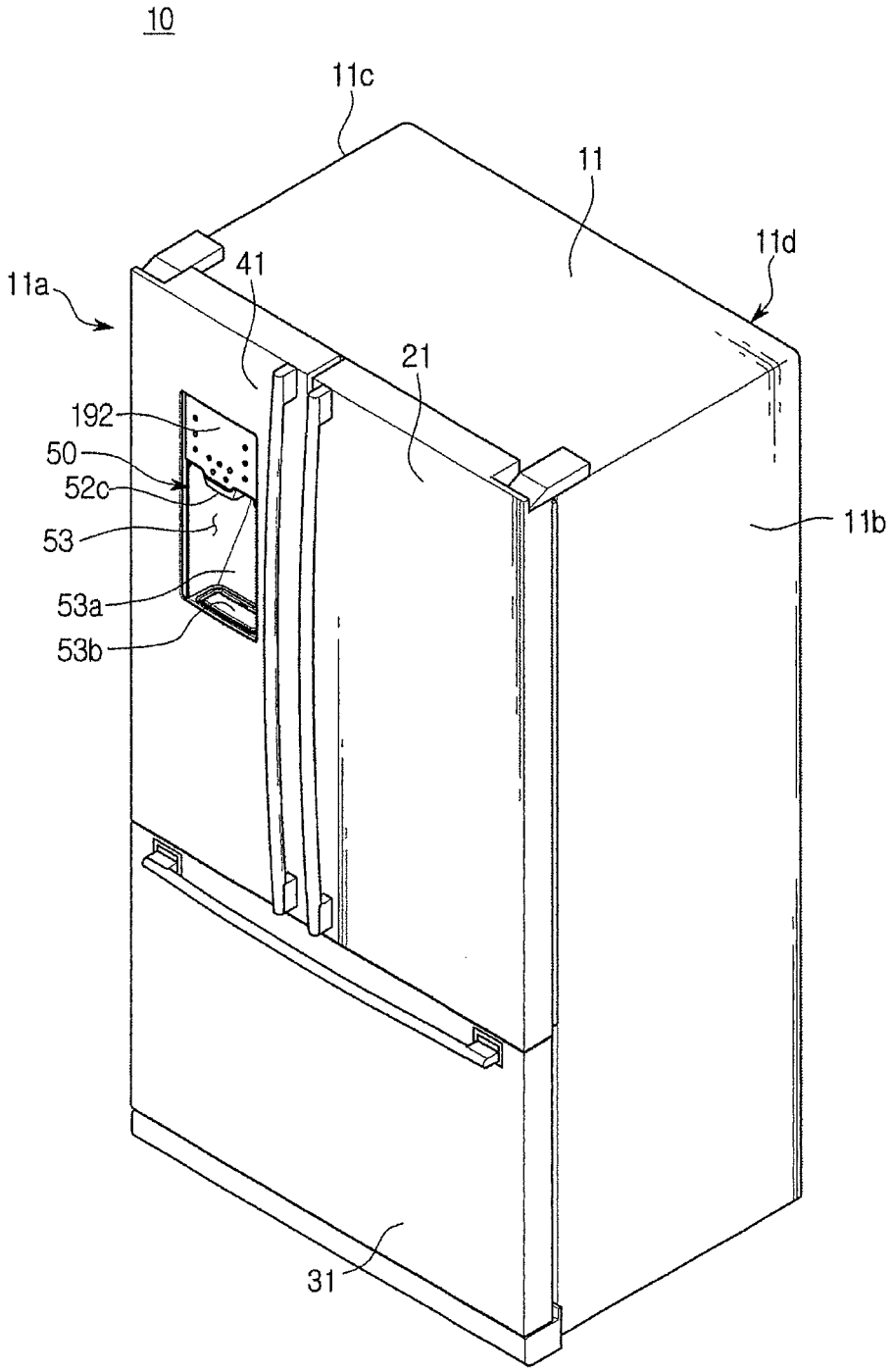
FIG. 2 is a perspective view illustrating an exterior of a refrigerator according to an embodiment.
Figure 3:
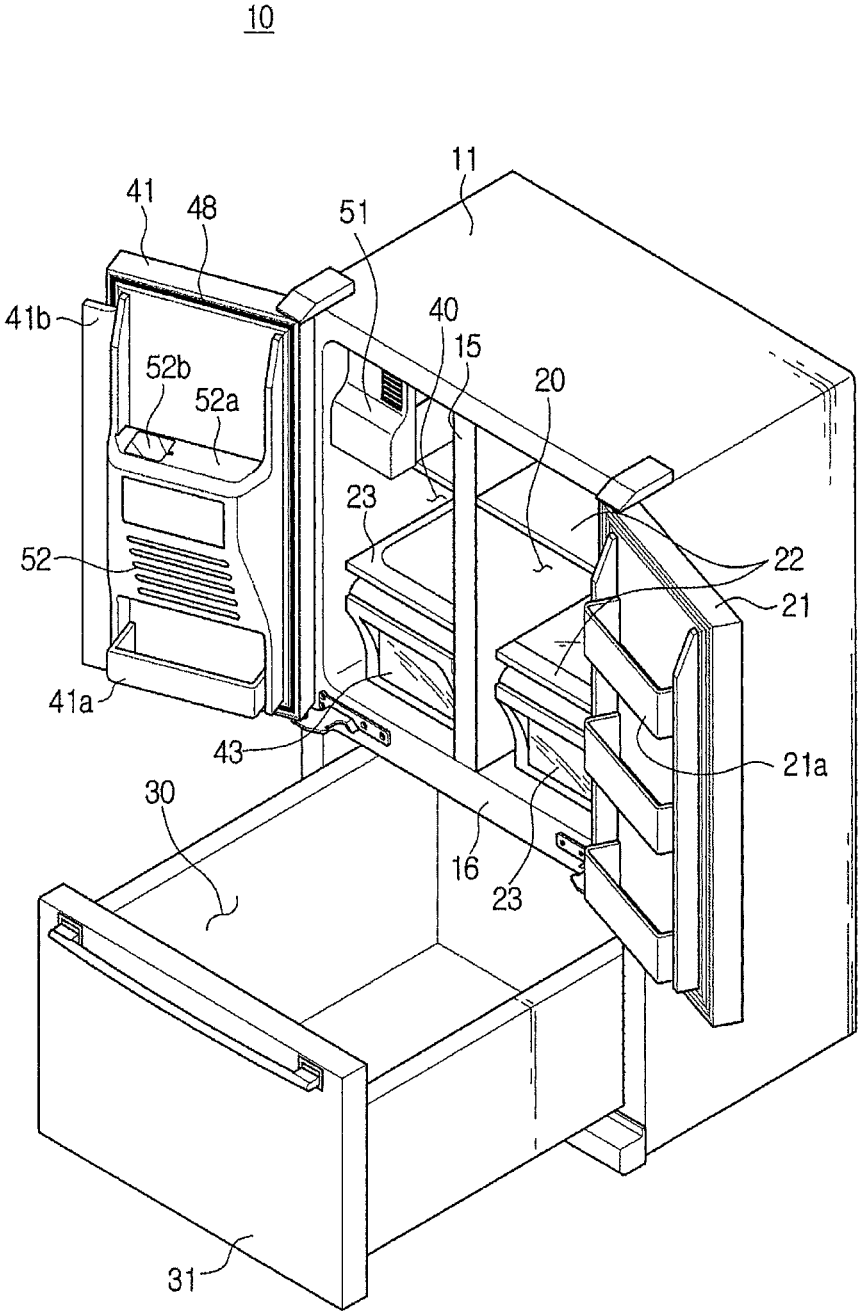
FIG. 3 is a perspective view illustrating an exterior of the refrigerator according to the embodiment when doors are opened.
Figure 4:
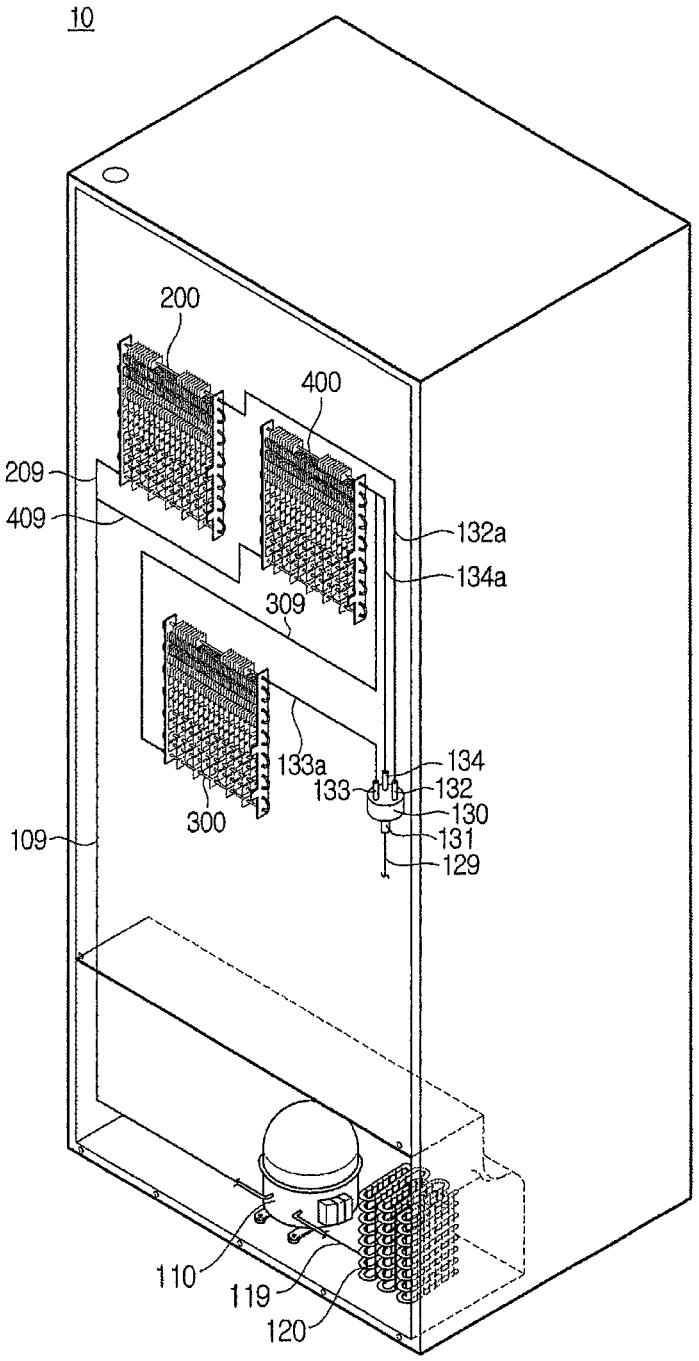
FIG. 4 is a view illustrating a rear surface of the refrigerator according to the embodiment.
Figure 5:
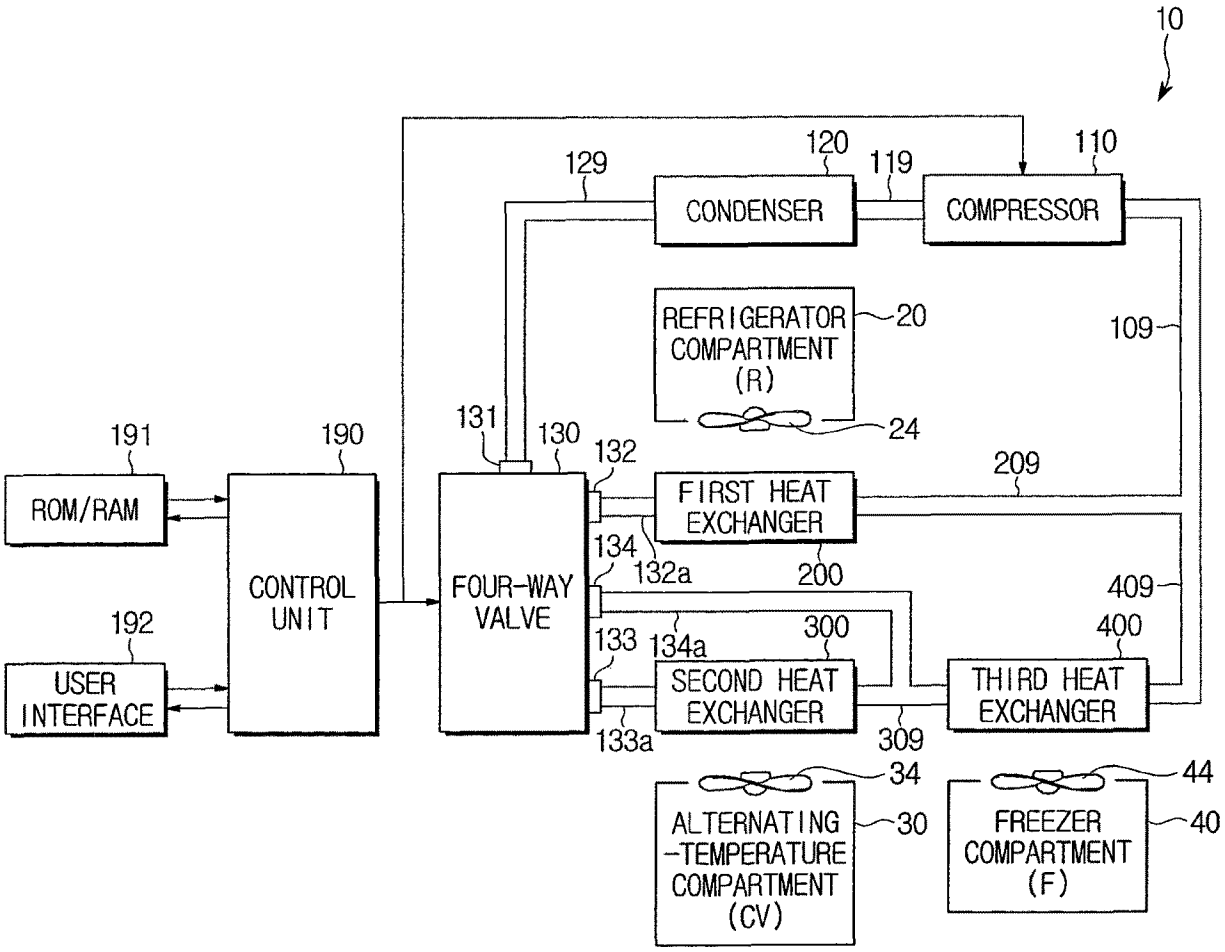
FIG. 5 is a view illustrating a refrigerator according to a first embodiment.
Figure 6:
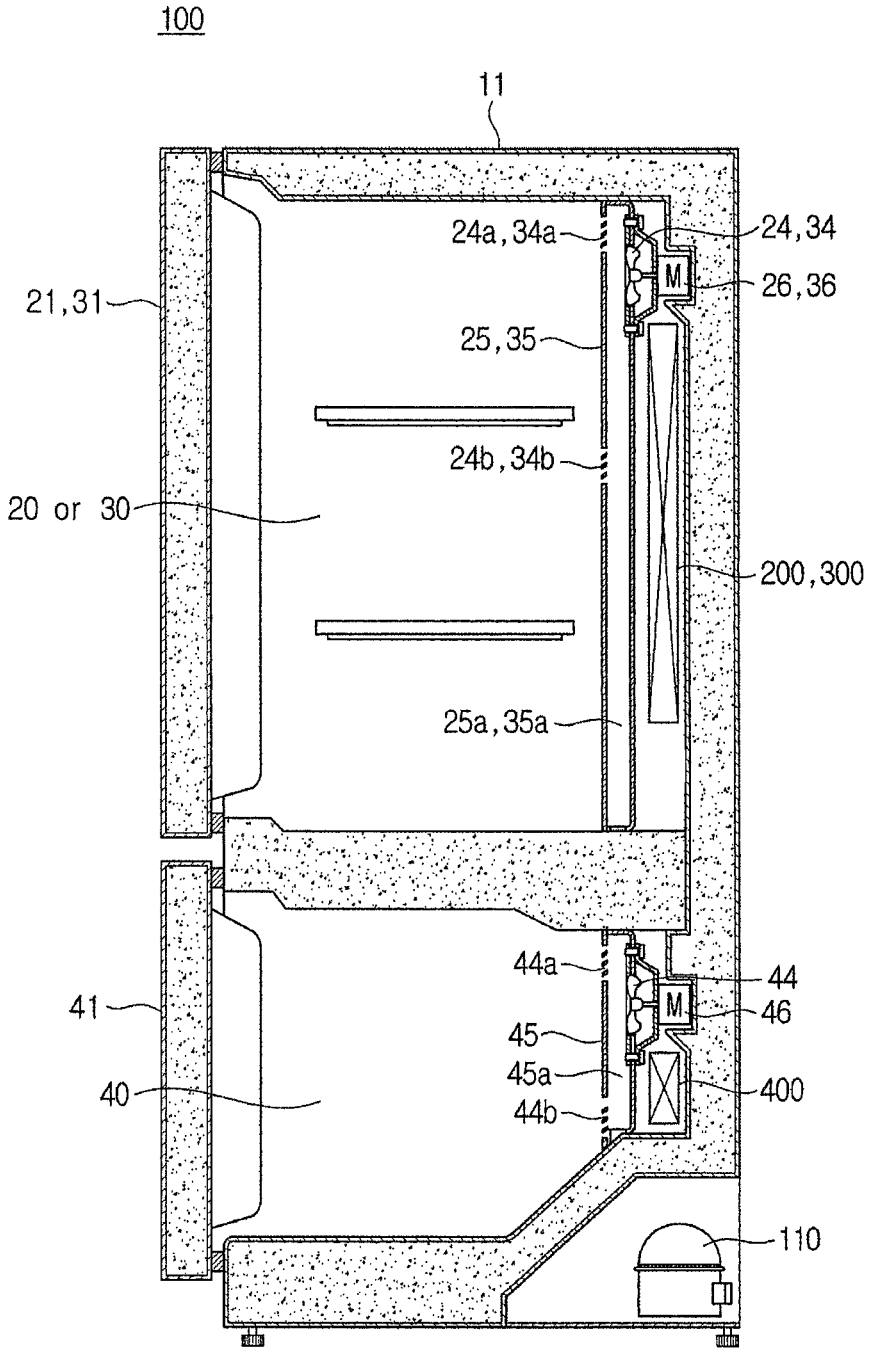
FIG. 6 is a side cross-sectional view of a refrigerator according to an embodiment.

FIG. 2 is a perspective view illustrating an exterior of a refrigerator according to an embodiment, and FIG. 3 is a perspective view illustrating an exterior of the refrigerator according to the embodiment when doors are opened. FIG. 4 is a view illustrating a rear surface of the refrigerator according to the embodiment, and FIG. 5 is a view illustrating a refrigerator according to a first embodiment. FIG. 6 is a side cross-sectional view of a refrigerator according to an embodiment.

Referring to FIG. 2, the refrigerator 10 may include a housing 11 to form an exterior of the refrigerator 10 and doors 21, 31, and 41 provided at one surface of the housing 11.

The housing 11 is configured to have a front surface 11*a* opened and surfaces 11*b* to 11*d* other than the front surface 11*a* closed. Storage compartments 20, 30, and 40 and various types of parts for cooling the storage compartments 20, 30, and 40 are provided at an inner portion of the housing 11.

One or more doors 21, 31, and 41 are installed to be opened and closed at the front surface 11*a* of the housing 11 as illustrated in FIGS. 2 and 3, and the storage compartments 20, 30, and 40 at the inner portion of the housing 11 are exposed to the outside in accordance with the opening and closing of the doors 21, 31, and 41. According to an embodiment, the doors 21 and 41 may be installed to be openable and closable at the housing 11 by being rotatably coupled to the housing 11 by a hinge provided at one portion of the front surface 11*a* of the housing 11. Also, according to another embodiment, the door 41 may be installed at the housing 11 in a form of a drawer to be discharged from the inner portion of the housing 11 to the outside by a rail and wheels (not shown), etc. installed at the inner portion of the housing 11.

The doors 21, 31, and 41 may be opened and closed independently of each other, and when the doors 21, 31, and 41 are opened as illustrated in FIG. 3, the storage compartments 20, 30, and 40 corresponding to the doors 21, 31, and 41 may be exposed to the outside. For example, when the first door 21 is rotated and moved around a hinge shaft, the first door 21 is opened, and the first storage compartment 20 provided at a position corresponding to the first door 21 may be exposed to the outside. The user may store and keep articles to be stored in the first storage compartment 20 through the opened front surface 11*a* of the housing 11.

A user interface 192 that may receive various types of commands related to an operation of the refrigerator 10 may be configured at a portion of the door 41. A position of the user interface 192 may be variously determined in accordance with a random choice of the designer.

The user interface 192 may include an input means to receive a user's command and an output means to provide various types of information to the user, and a physical button, a knob, a track ball, a touch pad, a touch button, a track pad, a lever, or an optical detection sensor, etc. ma be employed as the input means. A display or a speaker, etc. may be employed as the output means. In accordance with embodiments, the user interface 192 may include a touch screen capable performing both of the inputting and outputting functions.

A dispenser 50 capable of offering water, sparkling water, or ice, etc. may be installed at a portion of the door 41. The dispenser 50 may, for example, discharge ice formed from an ice making device 51 and provide the ice to the user. As illustrated in FIG. 3, the ice making device 51 may be configured at an inner portion of a storage compartment corresponding to the door 41 at which the dispenser 50 is installed, e.g. the second storage compartment 30.

The dispenser 50 may include a first outlet 50*c* through which water or ice, etc. is discharged and an intake space 53 from which the user obtains water or ice using a container, etc., and the first outlet 50*c* and the intake space 53 are configured to be exposed at a front surface of the door 41 such that acquiring water or ice, etc. is possible even without opening and closing the door 41. The intake space 53 may include an inclined surface 53*a* inclined by a predetermined angle such that the discharged water or ice smoothly flows toward a ground surface and a water collection case 53*b* in which the discharged water or ice is gathered.

A dispenser housing 52 in which various types of parts related to the operation of the dispenser 50 are embedded is configured at a rear surface of the door 41, and the dispenser housing 52 may protect the parts from an external impact while differentiating the space in which the parts are installed from the second storage compartment 30. A second outlet 52*b* may be formed at an upper surface 52*a* of the dispenser housing 52, and the second outlet 52*b* may be connected to the first outlet 50*c* to move the ice formed in the ice making device 51 to the intake space 53.

In accordance with embodiments, door guards 21*b* and 31*b* capable of accommodating various types of articles to be stored may be configured at rear surfaces of the doors 21 and 41 other than the dispenser housing 52, and a gasket 48 to seal a portion between the doors 21 and 41 and the housing 11 when the doors 21 and 41 are closed to prevent cold air in the storage compartments 20 and 40 from leaking to the outside may be configured at edges of the rear surfaces of the doors 21 and 41.

In addition, a rotary bar 41*b* to seal a portion between the first door 21 and the second door 41 when the doors 21 and 41 are closed to prevent the cold air in the storage compartments 20 and 40 from leaking to the outside may be installed at at least one of the doors 21 and 41.

Frames 15 and 16 to divide a space may be provided in the inner portion of the housing 11, and each of the frames 15 and 16 is coupled to the housing 11 to form the storage compartments 20, 30, and 40. In this case, the frames 15 and 16 may be formed of a material that is not prone to transferring heat in order to prevent cold air in any one of the storage compartments 20, 30, and 40 from being transferred to other storage compartments 20, 30, and 40.

Each of the storage compartments 20, 30, and 40 may store articles to be stored therein at a temperature equal to or lower than a predetermined temperature. The storage compartments 20, 30, and 40 may be sealed by the doors 21, 31, and 41, and the frames 15 and 16 such that the cold air is prevented from leaking to the outside or other storage compartments 20, 30, and 40. The storage compartments 20, 30, and 40 may be used as a refrigerator compartment (R in FIG. 5), an alternating-temperature compartment (CV in FIG. 5), and a freezer compartment (F in FIG. 5) in accordance with the set temperatures. For example, as illustrated in FIG. 5, the first storage compartment 20 may be used as the refrigerator compartment R, the second storage compartment 30 may be used as the alternating-temperature compartment CV, and the third storage compartment 40 may be used as the freezer compartment F, and each of the storage compartments 20, 30, and 40 may be controlled such that the inside air is cooled to a predetermined temperature in accordance with purpose of use.

The ice making device 51 to form ice may be installed in any one of the plurality of storage compartments 20, 30, and 40. The ice making device 51 may include an ice making chamber (51*a* in FIG. 16) in which ice is formed, a fourth heat exchanger (58 in FIG. 16) to form cold air, and a blower fan (58*a* in FIG. 16) to guide the cold air generated by the fourth heat exchanger 58 to the ice making chamber 51*a* inside the ice making device 51. Also, an outlet (not shown) through which formed ice is discharged may be formed at a lower surface of the ice making device 51, and the outlet of the ice making device 51 may be formed at a position corresponding to the second outlet 52*b* of the dispenser housing 52 at the lower surface of the ice making device 51 such that the formed ice may be discharged to the intake space 53.

Various forms of shelves 22 and 32 on which articles to be stored may be mounted may be installed and at least one of storage boxes 23 and 33 in which articles to be stored are sealed and stored may be configured at inner portions of the storage compartments 20 and 40. The at least one of the storage boxes 23 and 33 is configured in the storage compartments 20 and 40 to be withdrawn to the outside from the inner portions of the storage compartments 20 and 40 by the user. Other than the above, various devices for convenience of the user may be installed at the inner portions of the storage compartments 20 and 40.

Referring to FIGS. 4 to 6, a compressor 110, a condenser 120, a four-way valve 130, a first heat exchanger 200, a second heat exchanger 300, a third heat exchanger 400, and refrigerant passages 109, 119, 129, 132*a*, 133*a*, 134*a*, 209, 309, and 409 to connect the compressor 110, the condenser 120, the four-way valve 130, the first heat exchanger 200, the second heat exchanger 300, and the third heat exchanger 400 may be installed at the outer portion or the inner portion of the refrigerator 10.

The compressor 110 may be installed at a lower end portion of the rear surface 11*d* of the refrigerator 10, may receive refrigerant through a compressor refrigerant introduction passage 109 to compress the refrigerant, and may transfer the compressed refrigerant to the condenser 120 through a condenser refrigerant introduction passage 119.

The condenser 120 may be installed at the rear surface 11*d* of the refrigerator 10, may be installed at the lower end portion of the rear surface 11*d* of the refrigerator 10 as needed, or may be installed at a middle portion of the rear surface 11*d* of the refrigerator 10 to be exposed to the outside in order to easily emit heat. The refrigerant condensed in the condenser 120 may be transferred to the four-way valve through a four-way valve refrigerant introduction passage 129.

Figure 7:
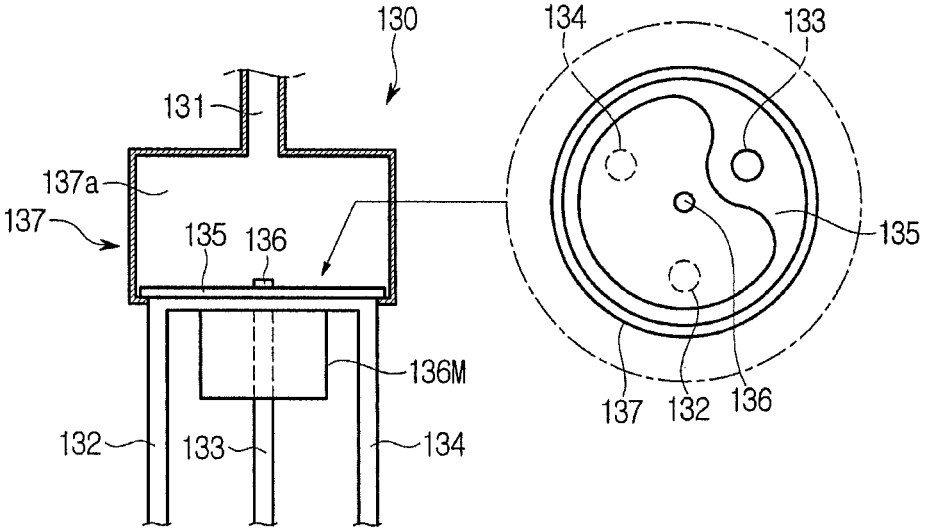
FIG. 7 is a view for describing a four-way valve according to an embodiment.

FIG. 7 is a view for describing a four-way valve according to an embodiment, and FIGS. 8A to 8D are views for describing an example of an operation to open and close a plurality of outlets provided at the four-way valve. FIGS. 9A to 9E are views for describing another example of the operation to open and close the plurality of outlets provided at the four-way valve.

The four-way valve 130 is a valve having four ports 131 to 134 through which fluid may enter and exit, and may open at least two of the four ports 131 to 134 in accordance with an external control to change a flow direction of fluid.

Referring to FIG. 7, the four-way valve 130 may include a refrigerant inlet 131, a first outlet 132, a second outlet 133, a third outlet 134, and an opening/closing means 135 to open at least one of the first outlet 132, the second outlet 133, and the third outlet 134 and close the other outlets.

The four-way valve 130 may include an exterior frame 137 and an inner space 137*a* formed by the exterior frame 137, and the refrigerant inlet 131 is configured such that refrigerant may be introduced into the inner space 137*a* of the four-way valve 130.

The opening/closing means 135 may be provided in the inner space 137*a*. According to an embodiment, the opening/closing means 135 may have a shape of a disk with one portion cut in order to open or close at least one of the first outlet 132, the second outlet 133, and the third outlet 134, and in this case, the opening/closing means 135 may rotate around a predetermined rotation shaft 136 as illustrated in FIGS. 8A to 9E. The opening/closing means 135 may be connected to a motor 136M that rotates in accordance with external control, and may rotate around the rotation shaft 136 in accordance with driving of the motor 136M. The rotation shaft 136 may be one that is disposed at a central portion of the opening/closing means 135 but the position of the rotation shaft 136 is not limited to the central portion, and the rotation shaft 136 may be configured at various positions in accordance with a designer's choice to rotate the opening/closing means 135.

Figure 8A:
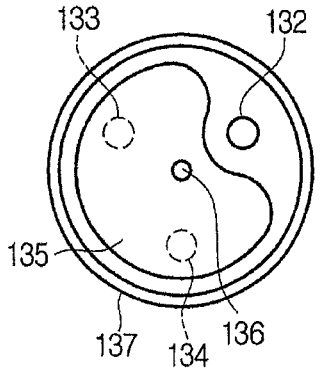
FIGS. 8A to 8D are views for describing an example of an operation to open and close a plurality of outlets provided at the four-way valve.

Referring to FIG. 8A, the cut portion of the disk shape may be disposed at a position at which any one of the plurality of outlets 132 to 134, e.g. the first outlet 132, is formed, and an uncut portion thereof may be disposed at a position at which the remaining outlets of the plurality of outlets 132 to 134, e.g. the second outlet 133 and the third outlet 134, are formed. In this case, the first outlet 132 at which the cut portion is disposed is opened and connected to the inner space 137*a*, and the second outlet 133 and the third outlet 134 at which the uncut portion is disposed are closed and not connected to the inner space 137*a*. Consequently, the refrigerant introduced through the refrigerant inlet 131 is discharged through the first outlet 132.

Figure 8B:
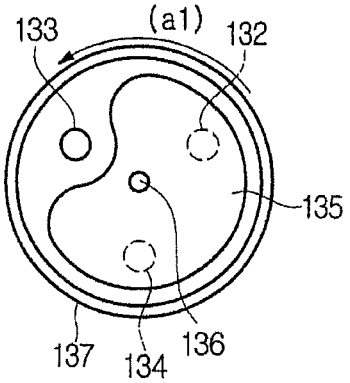

Referring to FIG. 8B, when the opening/closing means 135 rotates in a predetermined direction, the cut portion of the disk shape may be disposed at the second outlet 133, and the uncut portion may be disposed at the first outlet 132 and the third outlet 134. In this case, the second outlet 133 is opened and the first outlet 132 and the third outlet 134 are closed such that the refrigerant introduced through the refrigerant inlet 131 is discharged through the second outlet 133.

Figure 8C:
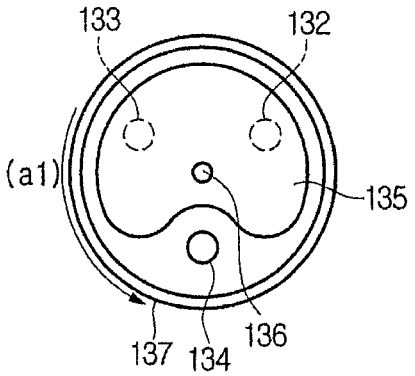

In addition, as illustrated in FIG. 8C, when the opening/closing means 135 continuously rotates in the same direction, the cut portion of the disk shape may be disposed at the third outlet 134, and the uncut portion may be disposed at the first outlet 132 and the second outlet 133. In this case, the third outlet 134 is opened and the first outlet 132 and the second outlet 133 are closed such that the refrigerant introduced through the refrigerant inlet 131 is discharged through the third outlet 134.

Figure 8D:
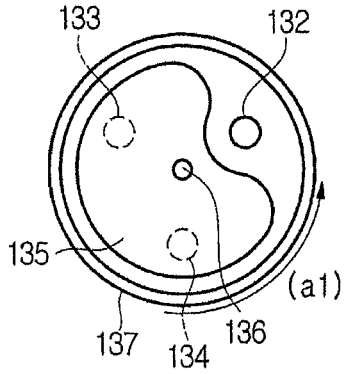

The third outlet 134 may be closed again and the first outlet 132 may be opened again, as illustrated in FIG. 8D, as needed.

The opening/closing means 135 may be stopped without rotating at a predetermined position to allow at least one of the first outlet 132, the second outlet 133, and the third outlet 134 to be opened or closed for a predetermined amount of time. When the first outlet 132, the second outlet 133, and the third outlet 134 which are opened have to be closed, or the outlets 132, 133, and 134 other than the opened outlets 132, 133, and 134 have to be opened, the opening/closing means 135 may begin moving and rotate by a proper angle.

In addition, the opening/closing means 135 may also close all of the first outlet 132, the second outlet 133, and the third outlet 134 in accordance with the degree of rotation. In other words, the uncut portion of the disk shape may be disposed at all of the first outlet 132, the second outlet 133, and the third outlet 134. In this case, the four-way valve 130 may not discharge the refrigerant to the outside.

According to an embodiment, as illustrated in FIGS. 8A to 8C, the first outlet 132, the second outlet 133, and the third outlet 134 may be sequentially opened in accordance with the rotation of the opening/closing means 135. When the first outlet 132, the second outlet 133, and the third outlet 134 are sequentially opened, the refrigerant may be sequentially transferred to the first heat exchanger 200, the second heat exchanger 300, and the third heat exchanger 400.

Figure 9A:
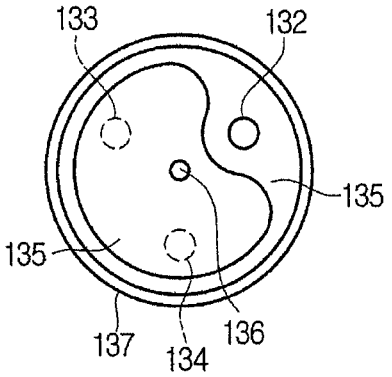
FIGS. 9A to 9E are views for describing another example of the operation to open and close the plurality of outlets provided at the four-way valve.
Figure 9B:
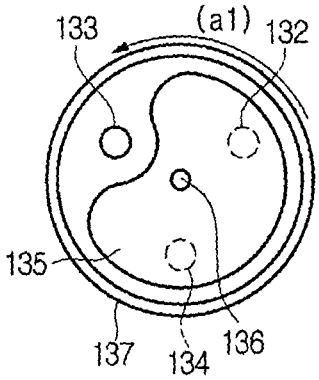
Figure 9C:
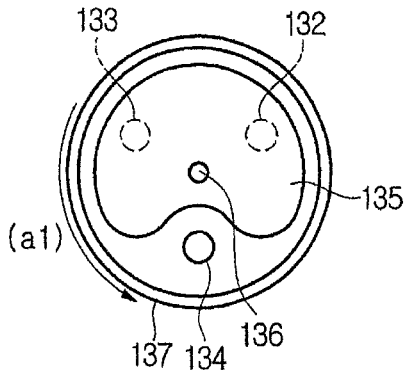
Figure 9D:
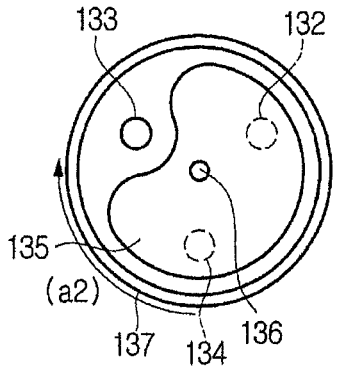
Figure 9E:
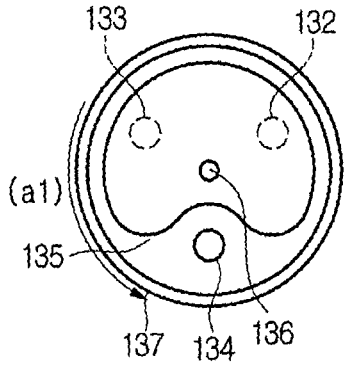

According to another embodiment, as illustrated in FIGS. 9A to 9E, at least two of the first outlet 132, the second outlet 133, and the third outlet 134 may be alternately opened. For example, when the first outlet 132 is opened, the opening/closing means 135 may rotate in a predetermined direction a1 as illustrated in FIGS. 9A and 9B to open the second outlet 133 and close the first outlet 132. Even after a predetermined amount of time, the opening/closing means 135 may rotate in the same direction a1 as illustrated in FIG. 9C to open the third outlet 134 and close the second outlet 133 again. After the third outlet 134 is opened and a predetermined amount of time is passed, the opening/closing means 135 may rotate in a direction a2 opposite from the predetermined direction a1 as illustrated in FIG. 9D to open the second outlet 133 again and close the third outlet 134 again. After the second outlet 133 is opened again and a predetermined amount of time is passed, the opening/closing means 135 may rotate again in the predetermined direction a1 as illustrated in FIG. 9E to open the third outlet 134 and close the second outlet 133 again. Consequently, the second outlet 133 and the third outlet 134 may be alternately opened or closed. As the second outlet 133 and the third outlet 134 are alternately opened or closed as above, the second heat exchanger 300 and the third heat exchanger 400 respectively connected to the second outlet 133 and the third outlet 134 alternately receive or not receive the refrigerant.

Although an embodiment in which only one of the first outlet 132, the second outlet 133, and the third outlet 134 is opened and other remaining outlets are closed has been described above, at least two of the first outlet 132, the second outlet 133, and the third outlet 134 may be opened and the remaining outlet may be closed in accordance with the form or the shape of the opening/closing means 135.

Although the four-way valve 130 that opens and closes the first outlet 132, the second outlet 133, and the third outlet 134 in accordance with the rotation of the opening/closing means 135 has been described above, the four-way valve 130 may open and close the first outlet 132, the second outlet 133, and the third outlet 134 using various other methods. For example, each of the outlets 132, 133, and 134 may be opened and closed using a barrier moving in the inner space 137*a*, or each of the outlets 132, 133, and 134 may be opened and closed by electronically controlling a door provided at each of the outlets 132, 133, and 134. Other than the above, the plurality of outlets 132 to 134 of the four-way valve 130 may be opened using various methods that may be considered by the designer.

In addition, the exterior of the four-way valve 130 is also not limited to the embodiment illustrated in FIG. 7, and the four-way valve 130 having various shapes may be employed in accordance with the designer's choice.

The four-way valve 130 may be installed at the inner portion or the outer portion of the housing 11 of the refrigerator 10. Here, the refrigerant inlet 131 may be connected to the condenser 120 through the four-way valve refrigerant introduction passage 129, the first outlet 132 may be connected to the first heat exchanger 200 through the first refrigerant passage 132*a*, the second outlet 133 may be connected to the second heat exchanger 300 through the second refrigerant passage 133*a*, and the third outlet 134 may be connected to the third heat exchanger 400 through the third refrigerant passage 134*a*.

The four-way valve 130 may open at least one of the first outlet 132, the second outlet 133, and the third outlet 134 to allow the refrigerant introduced through the refrigerant inlet 131 to be moved to at least one particular heat exchanger of the heat exchangers 200, 300, and 400.

Cold air may be generated in accordance with the refrigerant flow at the surroundings of the first heat exchanger 200, the second heat exchanger 300, and the third heat exchanger 400. The generated cold air may enter the storage compartments 20, 30, and 40 respectively corresponding to the heat exchangers 200, 300, and 400, and air temperatures in the inner portions of the storage compartments 20, 30, and 40 may be adjusted by the cold air that has entered the inner portions.

To efficiently adjust the air temperature of each of the storage compartments 20, 30, and 40, the first heat exchanger 200, the second heat exchanger 300, and the third heat exchanger 400 may be installed around the corresponding storage compartments 20, 30, and 40. For example, the first heat exchanger 200 may be installed around the first storage compartment 20, and the second heat exchanger 300 may be installed around the second storage compartment 30, and the third heat exchanger 400 may be installed around the third storage compartment 40.

The first heat exchanger 200, the second heat exchanger 300, and the third heat exchanger 400 may be installed at the inner portion of the rear surface 11*d* of the housing 11 of the refrigerator 10 as illustrated in FIG. 6. As mentioned above, the refrigerant flowing within the first heat exchanger 200, the second heat exchanger 300, and the third heat exchanger 400 lowers the temperature of the surroundings while absorbing latent heat at the surroundings, and thus cold air may be generated at the surroundings of the first heat exchanger 200, the second heat exchanger 300, and the third heat exchanger 400.

Blower fans 24, 34, and 44 for introducing the cold air generated in the first heat exchanger 200, the second heat exchanger 300, and the third heat exchanger 400 into the first storage compartment 20, the second storage compartment 30, and the third storage compartment 40, e.g. the refrigerator compartment R, the alternating-temperature compartment CV, and the freezer compartment F, may be configured at the surroundings of the first heat exchanger 200, the second heat exchanger 300, and the third heat exchanger 400. The blower fans 24, 34, and 44 move the generated cold air toward the storage compartments 20, 30, and 40 while being rotated by motors 26, 36, and 46.

The cold air that has been moving by the blower fans 24, 34, and 44 may move into the storage compartments 20, 30, and 40 through cold air outlets 24*a*, 24*b*, 34*a*, 34*b*, 44*a*, and 44*b* configured at inner walls 25, 35, and 45 of the storage compartments 20, 30, and 40, and the temperatures in the inner portions of the storage compartments 20, 30, and 40 are lowered due to the moved cold air. The inner walls 25, 35, and 45 of the storage compartments 20, 30, and 40 at which the cold air outlets 24*a*, 24*b*, 34*a*, 34*b*, 44*a*, and 44*b* are configured may include at least one of a frame forming a lateral surface or a rear surface of the storage compartments 20, 30, and 40, a frame forming a ceiling of the storage compartments 20, 30, and 40, and a frame forming a floor of the storage compartments 20, 30, and 40. Flow passages 25*a*, 35*a*, and 45*a* through which the cold air may flow may be configured at inner portions of the inner walls 25, 35, and 45 of the storage compartments 20, 30, and 40, and the cold air that has moved by the blower fans 24, 34, and 44 may be discharged through the several cold air outlets 24*a*, 24*b*, 34*a*, 34*b*, 44*a*, and 44*b* along the flow passages 25*a*, 35*a*, and 45*a*.

The refrigerant passages 109, 119, 129, 132*a*, 133*a*, 134*a*, 209, 309, and 409 may be configured to connect at least two of the compressor 110, the condenser 120, the first heat exchanger 200, the second heat exchanger 300, the third heat exchanger 400, and the four-way valve 130.

For example, the compressor refrigerant introduction passage 109 connects one or more heat exchangers 200 and 400 to the compressor 110 to transfer the refrigerant discharged from the heat exchangers 200 and 400 to the compressor 110, and the condenser refrigerant introduction passage 119 connects the compressor 110 to the condenser 120 to transfer the refrigerant discharged from the compressor 110 to the condenser 120. The four-way valve refrigerant introduction passage 129 may connect the condenser 120 to the four-way valve 130 to transfer the refrigerant discharged from the condenser 120 to the four-way valve 130. The four-way valve refrigerant introduction passage 129 may be configured by being extended from the refrigerant inlet 131 of the four-way valve 130. The first refrigerant passage 132*a*, the second refrigerant passage 133*a*, and the third refrigerant passage 134*a* are configured to connect the four-way valve 130 to the plurality of heat exchangers 200, 300, and 400 such that the refrigerant may flow to at least one of the plurality of heat exchangers 200, 300, and 400.

The first refrigerant passage 132*a*, the second refrigerant passage 133*a*, and the third refrigerant passage 134*a* may be respectively connected to the first outlet 132, the second outlet 133, and the third outlet 134 to transfer the refrigerant discharged from each of the outlets 132, 133, and 134 to each of the heat exchangers 200, 300, and 400.

As mentioned above, since the first outlet 132, the second outlet 133, and the third outlet 134 may be opened or closed in accordance with the movement of the opening/closing means 135, the refrigerant introduced into the four-way valve 130 may be transferred to at least one of the first heat exchanger 200, the second heat exchanger 300, and the third heat exchanger 400.

When the first heat exchanger 200 is connected to the first refrigerant passage 132*a* and the first outlet 132 of the four-way valve 130 is opened, the first heat exchanger 200 may receive the refrigerant through the first refrigerant passage 132*a*. The refrigerant evaporated in the first heat exchanger 200 may flow toward the compressor 110 through the fourth refrigerant passage 209.

According to an embodiment, as illustrated in FIG. 5, the first heat exchanger 200 may be connected to at least one of the second heat exchanger 300 and the third heat exchanger 400 in parallel. Thus, when the refrigerant is transferred to the first heat exchanger 200, none of the refrigerant may be transferred to the second heat exchanger 300 and the third heat exchanger 400. Consequently, the refrigerant is evaporated in the first heat exchanger 200 independently of the second heat exchanger 300 and the third heat exchanger 400, and the first storage compartment 20 which is the refrigerator compartment R may be cooled separately from the other storage compartments 30 and 40.

When the second heat exchanger 300 is connected to the second refrigerant passage 133*a* and the second outlet 133 of the four-way valve 130 is opened, the second heat exchanger 300 may receive the refrigerant through the second refrigerant passage 133*a*.

According to an embodiment, the second heat exchanger 300 may include a fifth refrigerant passage 309 that connects the second heat exchanger 300 to the third heat exchanger 400. Consequently, the refrigerant that has passed through the second heat exchanger 300 may also be introduced into the third heat exchanger 400. In other words, the second heat exchanger 300 and the third heat exchanger 400 may be serially connected. In this case, some of the refrigerant introduced into the third heat exchanger 400 may be the refrigerant evaporated in the second heat exchanger 300.

When the second heat exchanger 300 and the third heat exchanger 400 are serially connected, since the refrigerant sequentially passes through both of the second heat exchanger 300 and the third heat exchanger 400, the refrigerant may not only be evaporated in the second heat exchanger 300 but also in the third heat exchanger 400. As a result, air in the inner portion of the second storage compartment 30 and air in the inner portion of the third storage compartment 40 may be cooled together. Since the second outlet 133 of the four-way valve 130 and the second refrigerant passage 133*a* are connected as mentioned above, the air in the inner portion of the second storage compartment 30 and the air in the inner portion of the third storage compartment 40 may be cooled together when the second outlet 133 is opened.

According to an embodiment, the third refrigerant passage 134*a* is connected to the fifth refrigerant passage 309 such that the refrigerant that has been flowing through the third refrigerant passage 134*a* may enter and flow through the fifth refrigerant passage 309. The third refrigerant passage 134*a* and the fifth refrigerant passage 309 may be connected using a separate device such as a joint or may be connected by being directly welded.

As the third refrigerant passage 134*a* and the fifth refrigerant passage 309 are connected, the refrigerant that has been flowing through the third refrigerant passage 134*a* may flow to the third heat exchanger 400 through the fifth refrigerant passage 309. Since the third refrigerant passage 134*a* is connected to the third outlet 134 of the four-way valve 130, the refrigerant introduced into the four-way valve 130 may flow only to the third heat exchanger 400 through the third refrigerant passage 134*a* and the fifth refrigerant passage 309 when the third outlet 134 is opened.

In other words, the third heat exchanger 400 may receive the refrigerant that has passed through the second heat exchanger 300 through the fifth refrigerant passage 309 or directly receive the refrigerant from the four-way valve 130 through the third refrigerant passage 134*a* and the fifth refrigerant passage 309.

As a result, cold air may be simultaneously generated in the third heat exchanger 400 and the second heat exchanger 300 or cold air may be independently generated in the third heat exchanger 400 separately from the second heat exchanger 300. Accordingly, the temperature of the third storage compartment 40 which is the freezer compartment F may be adjusted together with the temperature of the second storage compartment 30 which is the alternating-temperature compartment CV or may be adjusted independently.

A sixth refrigerant passage 409 may be configured at the third heat exchanger 400 to allow the refrigerant evaporated in the third heat exchanger 400 to flow. According to an embodiment, the sixth refrigerant passage 409 may be configured by being extended from the compressor refrigerant introduction passage 109. Consequently, the refrigerant that has been evaporated in the third heat exchanger 400 may be supplied to the compressor 110. Also, the sixth refrigerant passage 409 may be connected to the fourth refrigerant passage 209 through which the refrigerant discharged from the first heat exchanger 200 flows.

The refrigerant passages 109, 119, 129, 132*a*, 133*a*, 134*a*, 209, 309, and 409 may be disposed at random positions in accordance with the designer's choice.

Although the structure in which the compressor 110, the condenser 120, the first heat exchanger 200, the second heat exchanger 300, the third heat exchanger 400, and the refrigerant passages 109, 119, 129, 132*a*, 133*a*, 134*a*, 209, 309, and 409 are installed around the rear surface 11*d* is illustrated in FIG. 4 for convenience of description, the positions thereof are not limited to those illustrated in FIG. 4. In accordance with embodiments, the positions thereof may be changed in accordance with random choices of the designer. For example, the first heat exchanger 200 may be installed on the ceiling of the first storage compartment 20. Also, in another example, the first heat exchanger 200, the second heat exchanger 300, and the third heat exchanger 400 may be disposed in various ways in accordance with positions of the storage compartments 20, 30, and 40 cooled by the first heat exchanger 200, the second heat exchanger 300, and the third heat exchanger 400.

In addition, although various types of parts such as an expansion valve and a capillary tube are omitted and not displayed in FIGS. 4 to 6 for convenience of description, the various types of parts such as an expansion valve or a capillary tube may also be configured in the refrigerator 10 in accordance with embodiments. For example, an expansion valve may be configured between the condenser 120 and the four-way valve 130, and in this case, the four-way valve refrigerant introduction passage 129 may be configured to connect the expansion valve to the four-way valve 130. In another example, one or more capillary tubes may be configured between the condenser 120 and the four-way valve 130 or between the four-way valve 130 and each of the heat exchangers 200, 300, and 400.

A control unit 190 for controlling the refrigerator 10 and a part for assisting in the operation of the control unit 190, e.g. a storage device 191 such as a random access memory (RAM) or a read-only memory (ROM), may be configured at the inner portion of the refrigerator 10.

The control unit 190 may control the overall operation of the refrigerator 10, control the operation of the refrigerator 10 in accordance with inputs to the user interface 192, or control the operation of the refrigerator 10 in accordance with preset values.

For example, when the user has set the temperature of each of the storage compartments 20, 30, and 40 by manipulating the user interface 192, the control unit 190 may selectively open or close each of the outlets 132, 133, and 134 of the four-way valve 130 in accordance with the set temperature, and the refrigerant may flow to or not flow to each of the heat exchangers 200, 300, and 400 in accordance with opening and closing of each of the outlets 132, 133, and 134. Accordingly, the temperature of each of the storage compartments 20, 30, and 40 may be controlled. In this case, the control unit 190 may generate a predetermined control signal in accordance with the user's manipulation and transmit the control signal to the motor 136M of the four-way valve 130 to rotate the opening/closing means 135, thereby opening or closing each of the outlets 132, 133, and 134.

In this case, the control unit 190 may control the four-way valve 130 such that the first outlet 132, the second outlet 133, and the third outlet 134 are sequentially opened or closed, or control the four-way valve 130 such that at least two (133 and 134 in FIGS. 9A to 9D) of the first outlet 132, the second outlet 133, and the third outlet 134 are alternately opened. By controlling the first outlet 132, the second outlet 133, and the third outlet 134 to be sequentially opened or closed or controlling at least two of the first outlet 132, the second outlet 133, and the third outlet 134 to be alternately opened, the control unit 190 may adjust inner temperatures of particular storage compartments 20, 30, and 40.

In addition, in another example, the control unit 190 may transfer the control signal to the compressor 110 such that a motor of the compressor 110 is driven at a predetermined rotation speed, and accordingly, a circulation speed, etc. of the refrigerant passing through the condenser 120 or the heat exchangers 200, 300, and 400 may be adjusted.

The control unit 190 may be realized using a central processing unit (CPU) or a micro controller unit (MCU), and the CPU or the MCU may include one or more semiconductor chips and circuits connected thereto.

The CPU or the MCU being operated by the control unit 190 may be installed at a printed circuit board (not shown) embedded in the refrigerator 10. The CPU, the MCU, the printed circuit board, or related parts may be installed at random positions of the refrigerator 10 in accordance with the designer's choice. For example, the CPU, the MCU, the printed circuit board, or the related parts may be embedded in the doors 21, 31, and 41 or installed at the inner portion of the rear surface 11*d* of the refrigerator 10.

The storage device 191 may assist in the operation of the control unit 190 and temporarily or permanently store various types of data. The storage device 191 may be implemented using various devices such as a semiconductor storage device or a magnetic disk storage device. The set temperature of each of the storage compartments 20, 30, and 40 input from the user interface 192 may be stored in a form of digital data in the storage device 191.

As described above, at least one of the plurality of heat exchangers 200, 300, and 400 may be individually controlled by only operating one compressor 110 due to the four-way valve 130, the first heat exchanger 200, the second heat exchanger 300, and the third heat exchanger 400 being connected and each of the outlets 132, 133, and 134 of the four-way valve 130 being opened or closed by the control unit 190. Accordingly, independent cooling of at least one of the storage compartments 20, 30, and 40 may be performed.

Figure 10:
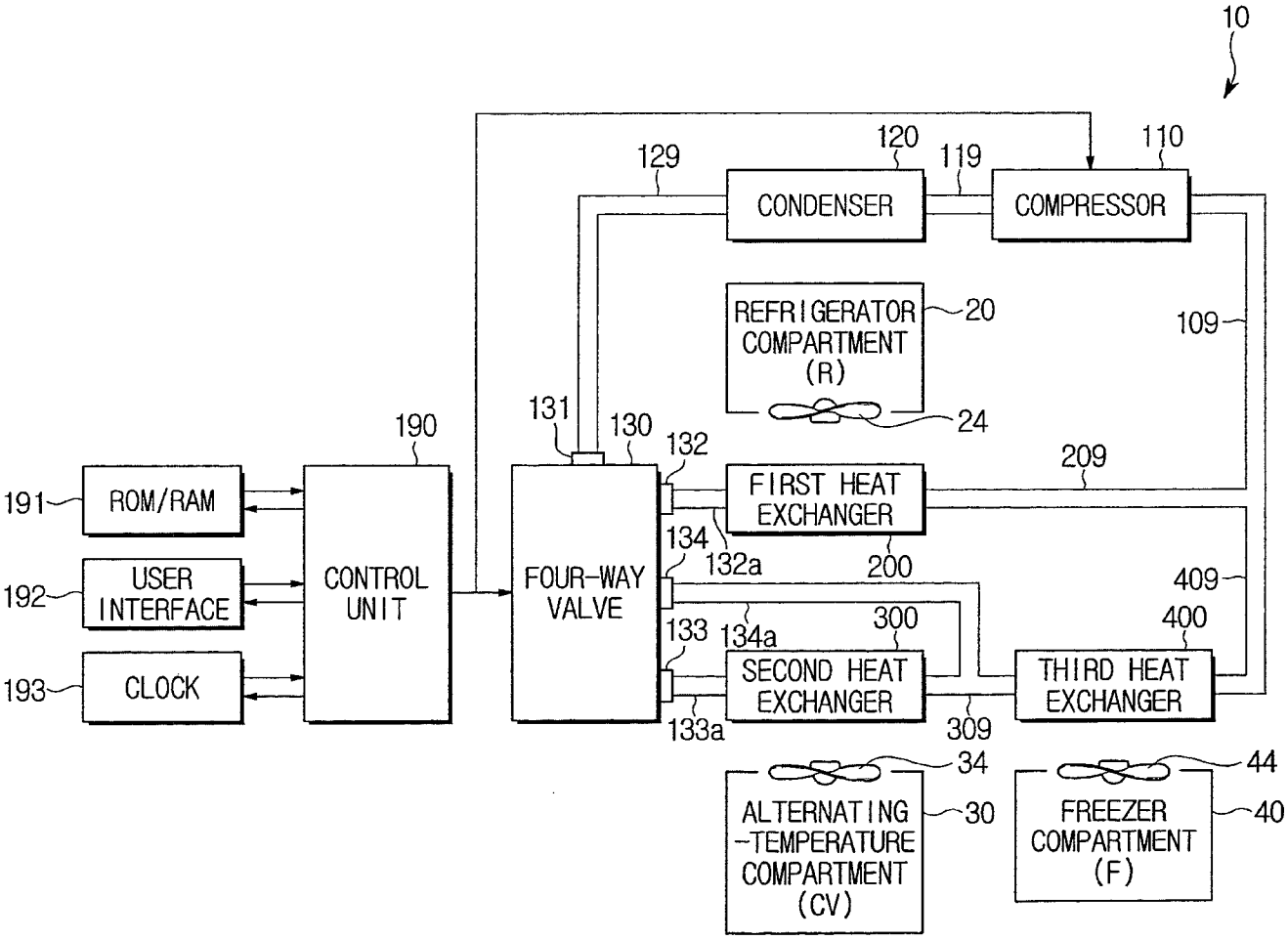
FIG. 10 is a view illustrating a refrigerator according to a second embodiment.

FIG. 10 is a view illustrating a refrigerator according to a second embodiment.

According to the second embodiment of the refrigerator 10 illustrated in FIG. 10, the refrigerator 10 may include the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, the control unit 190, the storage device 191, and a clock 193. Since the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, and the storage device 191 have been described already, the description thereof will be omitted.

The clock 193 may output a predetermined electrical signal in accordance with the elapsed time from a current time or a reference time to transmit the electrical signal to the control unit 190. Accordingly, the control unit 190 may acquire information on the current time or elapsed time. The control unit 190 may determine whether to open and close the first outlet 132, the second outlet 133, and the third outlet 134 of the four-way valve 130 based on the information transmitted from the clock 193, and transmit the control signal to the four-way valve 130, e.g. the motor 136M, in accordance with the determined result. Accordingly, each of the outlets 132, 133, and 134 of the four-way valve 130 may be opened or closed at a predetermined time. In other words, a timing control of each of the outlets 132, 133, and 134 becomes possible.

Since other functions of the control unit 190 have been described already, the detailed description thereof will be omitted.

Figure 11:
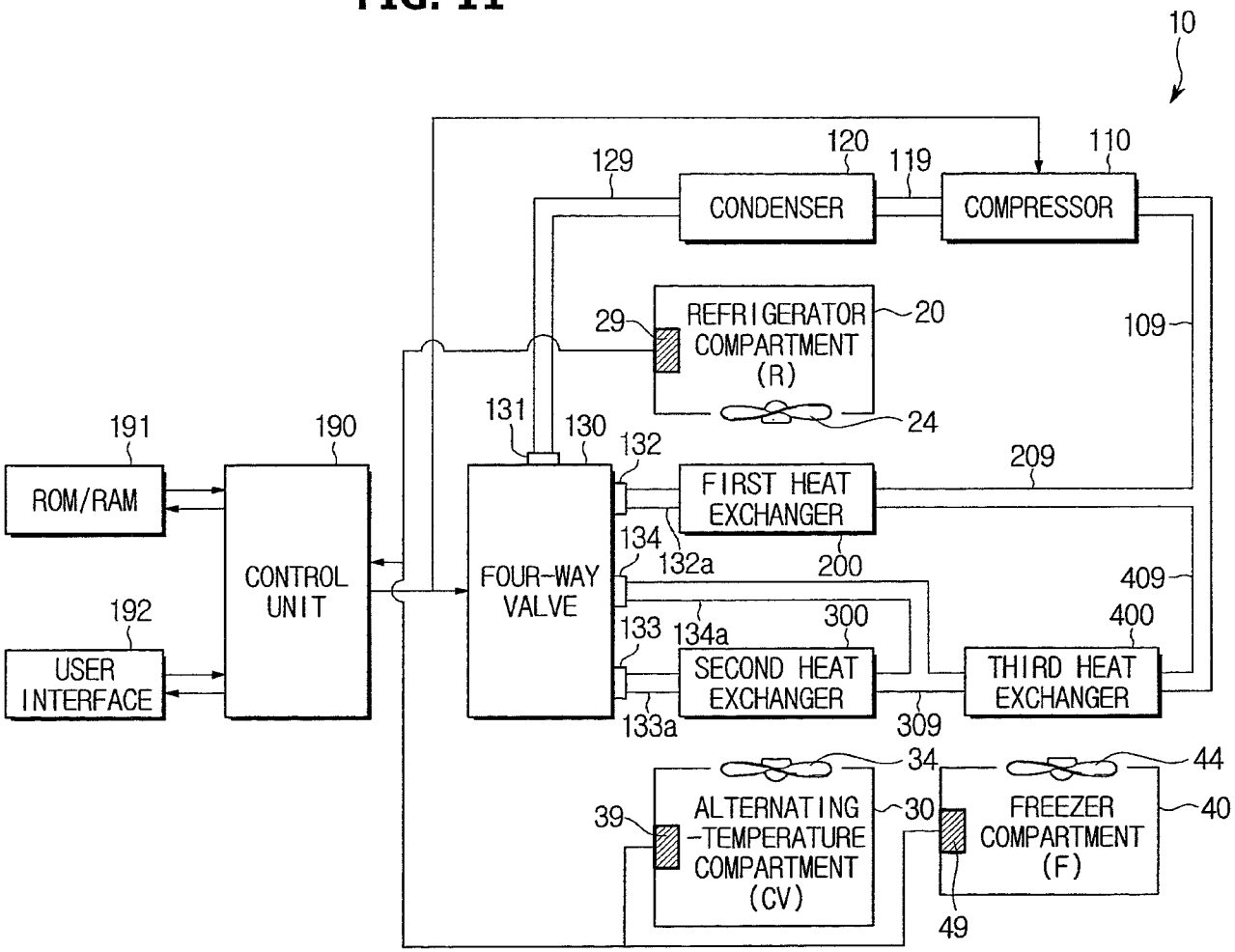
FIG. 11 is a view illustrating a refrigerator according to a third embodiment.

FIG. 11 is a view illustrating a refrigerator according to a third embodiment.

According to the third embodiment of the refrigerator 10 illustrated in FIG. 11, the refrigerator 10 may include the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, the control unit 190, the storage device 191, and at least one of storage compartment temperature measurement units 29, 39, and 49. Since the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, and the storage device 191 have been described already, the detailed description thereof will be omitted.

A first storage compartment temperature measurement unit 29, a second storage compartment temperature measurement unit 39, and a third storage compartment temperature measurement unit 49 may be respectively installed at corresponding storage compartments 20, 30, and 40 to measure the inner temperatures of the storage compartments 20, 30, and 40 and to output an electrical signal corresponding to the measurement results to transmit the electrical signal to the control unit 190.

The storage compartment temperature measurement units 29, 39, and 49 may be installed at random positions at the ceiling, the floor, or the inner walls 25, 35, and 45 of the inner portions of the storage compartments 20, 30, and 40 in order to measure the air temperatures of the inner portions of the storage compartments 20, 30, and 40.

A bimetal thermometer, a thermistor thermometer, or an infrared thermometer, etc. may be employed as the storage compartment temperature measurement units 29, 39, and 49, and various temperature measurement tools other than the above that may be considered by the designer may be used as the storage compartment temperature measurement units 29, 39, and 49.

The control unit 190 may control the air temperatures in the inner portions of the first storage compartment 20, the second storage compartment 30, and the third storage compartment 40 by opening and closing the first outlet 132, the second outlet 133, and the third outlet 134 of the four-way valve 130 in accordance with the air temperature measured in at least one of the first storage compartment temperature measurement unit 29, the second storage compartment temperature measurement unit 39, and the third storage compartment temperature measurement unit 49. For example, when the temperature of the first storage compartment 20 has reached the predetermined set temperature, the first outlet 132 connected to the first storage compartment 20 may be closed and at least one of the other outlets 133 and 134 may be opened to adjust a temperature of at least one of the second storage compartment 30 and the third storage compartment 40.

Specifically, the control unit 190 may determine the air temperature of each of the storage compartments 20, 30, and 40 in accordance with the electrical signal received from at least one of the first storage compartment temperature measurement unit 29, the second storage compartment temperature measurement unit 39, and the third storage compartment temperature measurement unit 49, and determine whether to open or close the first outlet 132, the second outlet 133, and the third outlet 134 of the four-way valve 130 based on the determined result. The control unit 190 generates the predetermined control signal in accordance with the determined result of whether to open or close the outlets 132, 133, and 134 and transmits the generated control signal to the four-way valve 130, e.g. the motor 136M, to open or close at least one of the outlets 132, 133, and 134 of the four-way valve 130. Accordingly, each of the outlets 132, 133, and 134 of the four-way valve 130 may be opened or closed in accordance with the air temperatures in the storage compartments 20, 30, and 40, and as a result, the inner temperatures of the storage compartments 20, 30, and 40 may be precisely adjusted.

Since other functions of the control unit 190 have been already described, additional description thereof will be omitted here.

Hereinafter, an example of a method of controlling the refrigerator according to the first embodiment will be described with reference to FIGS. 12 to 13D.

Figure 12:
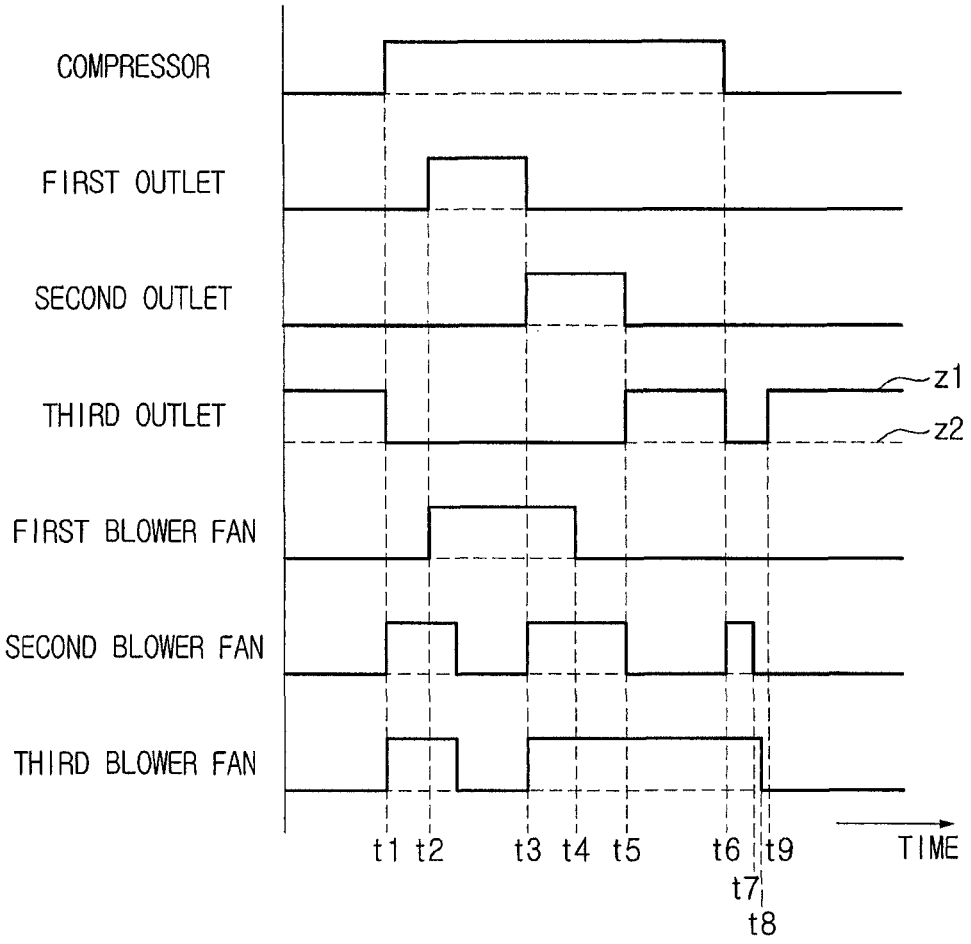
FIG. 12 is a graph for describing an example of opening and closing a first outlet, a second outlet, and a third outlet of the four-way valve and a refrigerant flow in the refrigerator according to the first embodiment.

FIG. 12 is a graph for describing an example of opening and closing a first outlet, a second outlet, and a third outlet of the four-way valve and a refrigerant flow in the refrigerator according to the first embodiment, and FIGS. 13A to 13D are views for describing the example of opening and closing the first outlet, the second outlet, and the third outlet of the four-way valve and the refrigerant flow in the refrigerator according to the first embodiment.

In FIG. 12, a horizontal direction represents elapsed time, and farther in the rightward direction in FIG. 12 represents that more time has elapsed. Also, an extension line indicated at each device represents an operation state of the device, in which a higher portion represents the device in operation, and a lower portion represents the device in non-operation.

Meanwhile, although an embodiment in which the first storage compartment 20 serves as the refrigerator compartment R, the second storage compartment 30 serves as the alternating-temperature compartment CV, and the third storage compartment 40 serves as the freezer compartment F will be described below, the refrigerator 10 may be controlled similar to the following description, even when the first storage compartment 20, the second storage compartment 30, and the third storage compartment 40 perform different functions.

Figure 13A:
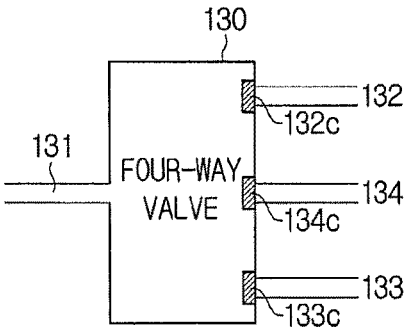
FIGS. 13A to 13D are views for describing the example of opening and closing the first outlet, the second outlet, and the third outlet of the four-way valve and the refrigerant flow in the refrigerator according to the first embodiment.

As illustrated in FIGS. 12 and 13A, when the refrigerator 10 is operated at a first time t1 and the compressor 110 begins operating, first, the outlets 132 to 134 other than the refrigerant inlet 131 may not be opened (132*c*, 133*c*, and 134*c*). In this case, when an opened outlet such as the third outlet 134 exists (z1), the third outlet 134 is closed in accordance with the control signal of the control unit 190.

In accordance with embodiments, the second blower fan 34 configured at the second storage compartment 30 and the third blower fan 44 configured at the third storage compartment 40 may be operated for defrosting the inner portion of the second storage compartment 30 and the inner portion of the third storage compartment 40 while the refrigerant pump-down operation is performed. The operations of the second blower fan 34 and the third blower fan 44 may be performed for approximately five minutes, for example.

The refrigerant pump-down operation may be omitted in accordance with embodiments.

Figure 13B:
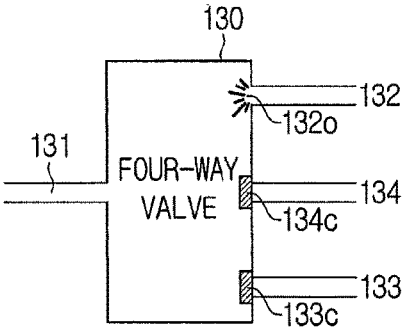

When a second time t2 is reached after the refrigerant pump-down operation has begun, the first outlet 132 may be opened as illustrated in FIG. 13B (132*o*). When the first outlet 132 is opened, the refrigerant may be introduced into the first heat exchanger 200 connected to the first outlet 132. The first heat exchanger 200 may generate the cold air supplied to the first storage compartment 20 that operates as the refrigerator compartment R.

As the first outlet 132 is opened, or when a predetermined amount of time has elapsed after the first outlet 132 is opened, the first blower fan 24 begins a blowing operation while rotating, and the cold air generated in the first heat exchanger 200 flows to the first storage compartment 20 in accordance with the blowing operation of the first blower fan 24. Consequently, the air temperature in the refrigerator compartment R is lowered.

Meanwhile, even after the first outlet 132 is opened, the second blower fan 34 and the third blower fan 44 may still operate and may stop operating after a predetermined amount of time elapses.

Figure 13C:
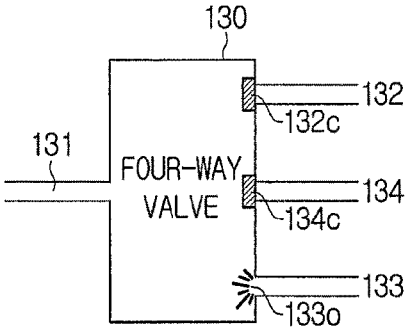

As illustrated in FIGS. 12 and 13C, when a third time t3 is reached, the first outlet 132 may be closed (132*c*) and the second outlet 133 may be opened (133*o*) such that a direction in which the refrigerant flows may be switched.

When the second outlet 133 is opened, the refrigerant may be transferred to the second heat exchanger 300, and the refrigerant that has passed through the second heat exchanger 300 may be transferred to the third heat exchanger 400 serially connected to the second heat exchanger 300. Consequently, cold air is generated at the surroundings of the second heat exchanger 300 and the third heat exchanger 400, and the air temperatures of the second storage compartment 30 and the third storage compartment 40 are lowered As the second outlet 133 is opened, or when a predetermined amount of time has elapsed after the second outlet 133 is opened, the second blower fan 34 and the third blower fan 44 configured in the second storage compartment 30 and the third storage compartment 40, respectively, begin operating. The cold air generated in the second heat exchanger 300 and the third heat exchanger 400 in accordance with the operations of the second blower fan 34 and the third blower fan 44 flow into the second storage compartment 30 and the third storage compartment 40, and the air temperatures of the second storage compartment 30 and the third storage compartment 40 are lowered.

Meanwhile, the first blower fan 24 may continuously operate until a fourth time t4 for natural defrosting even after the flow of the refrigerant to the first heat exchanger 200 is stopped. The operation of the first blower fan 24 may be set to be continued for approximately 15 to 30 minutes, for example.

Figure 13D:
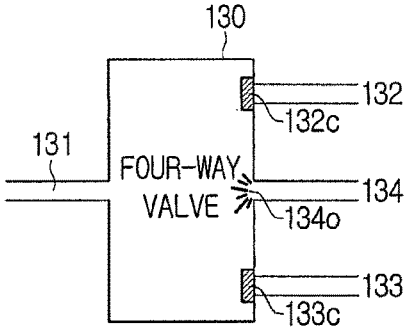

When a fifth time t5 is reached, the second outlet 133 may be closed (133*c*) and the third outlet 134 may be opened (134*o*) as illustrated in FIG. 13D. In other words, the first outlet 132, the second outlet 133, and the third outlet 134 may be sequentially opened. Due to the closing of the second outlet 133 and the opening of the third outlet 134, the refrigerant may be transferred only to the third heat exchanger 400 without being transferred to the second heat exchanger 300.

When the second outlet 133 is closed and the third outlet 134 is opened, the second blower fan 34 may stop operating while the third blower fan 44 may keep operating. Consequently, cold air is continuously supplied to the third storage compartment 40 and the air temperature of the third storage compartment 40 is further lowered. Accordingly, the inner temperature of the third storage compartment 40 becomes lower than the inner temperatures of other storage compartments 20 and 30, and thus the third storage compartment 40 may serve as the freezer compartment F.

When a sixth time t6 is reached, the third outlet 134 may also be closed as illustrated in FIG. 13A, and thus, all of the outlets 132, 133, and 134 are closed.

In this case, the second blower fan 34 may begin operating again for naturally defrosting the second storage compartment 30. The third blower fan 44 may also keep operating even when the third outlet 134 is closed and the refrigerant does not flow to the third heat exchanger 400 for naturally defrosting the third storage compartment 40.

The second blower fan 34 may stop operating at a seventh time t7, and the third blower fan 44 may stop operating at an eighth time t8 which is later than the seventh time t7. For example, the second blower fan 34 may stop operating approximately three minutes after all of the outlets 132, 133, and 134 are closed, and the third blower fan 44 may stop operating approximately four minutes after all of the outlets 132, 133, and 134 are closed.

When a ninth time t9 is reached, the third outlet 134 may be opened again in accordance with whether the refrigerator 10 performs differential pressure starting. For example, when the refrigerator 10 does not perform differential pressure starting, the third outlet 134 may be opened again (z1). In this case, a difference between the sixth time t6 and the ninth time t9 may be approximately five minutes, for example. When the refrigerator 10 performs differential pressure starting, the third outlet 134 may continuously remain closed (z2).

Meanwhile, in FIG. 12, the third time t3 to the ninth time t9 may be fixed in accordance with predetermined settings, or may be changeable in accordance with conditions. For example, the third time t3 to the ninth time t9 may be changed in accordance with the air temperature of the inner portion of the first storage compartment 20, or may be changed in accordance with the set temperature determined in accordance with manipulation of the user interface 192. The second time t2 may also be fixed or changeable.

Hereinafter, another example of a method of controlling the refrigerator according to the first embodiment will be described with reference to FIGS. 14 to 15D.

Figure 14:
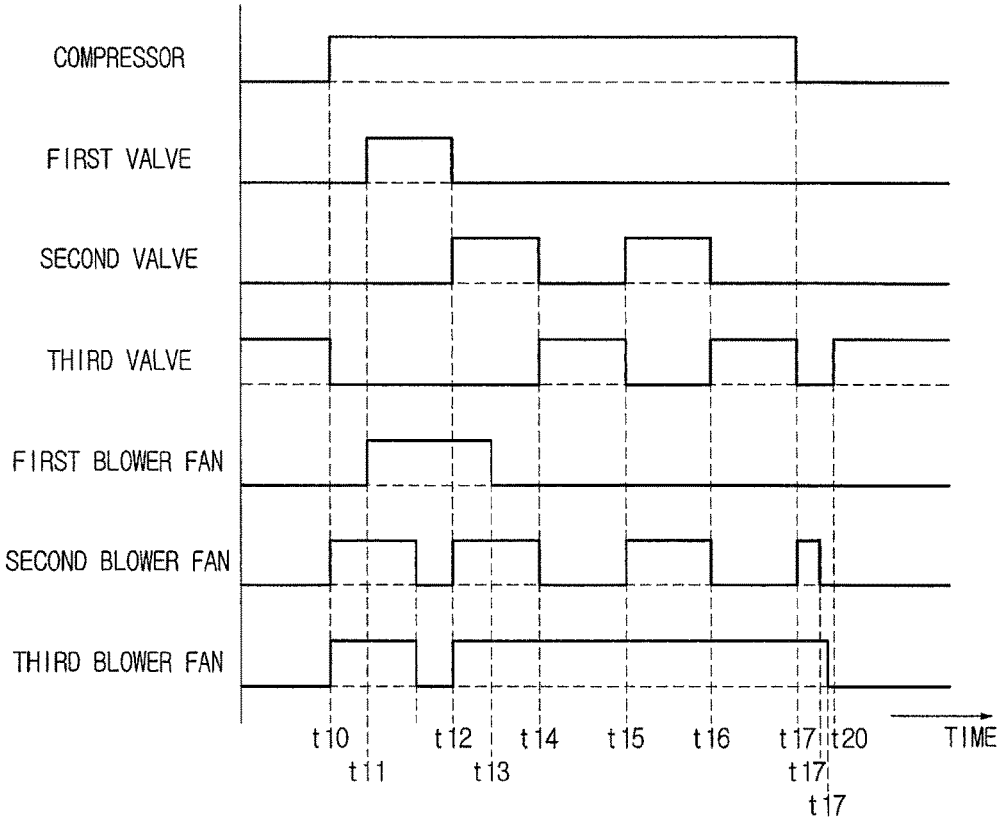
FIG. 14 is a graph for describing another example of opening and closing the first outlet, the second outlet, and the third outlet of the four-way valve and the refrigerant flow in the refrigerator according to the first embodiment.

FIG. 14 is a graph for describing another example of opening and closing the first outlet, the second outlet, and the third outlet of the four-way valve and the refrigerant flow in the refrigerator according to the first embodiment, and FIGS. 15A to 15F are views for describing another example of opening and closing the first outlet, the second outlet, and the third outlet of the four-way valve and the refrigerant flow in the refrigerator according to the first embodiment.

Same as in FIG. 12, a horizontal direction in FIG. 14 represents elapsed time, and farther in the rightward direction represents that more time has elapsed. Also, an extension line indicated at each device represents an operation state of the device, in which a higher portion represents the device in operation, and a lower portion represents the device in non-operation.

Figure 15A:
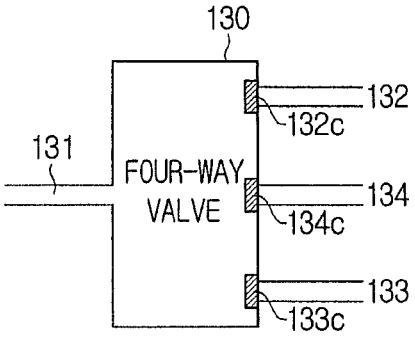
FIGS. 15A to 15F are views for describing another example of opening and closing the first outlet, the second outlet, and the third outlet of the four-way valve and the refrigerant flow in the refrigerator according to the first embodiment.

As illustrated in FIG. 14, when the compressor 110 begins operating at a tenth time t10, the refrigerant pump-down operation may be performed. In this case, the outlets 132 to 134 other than the refrigerant inlet 131 may not be opened as illustrated in FIG. 15A (132*c*, 133*c*, 134*c*). When the third outlet 134 is opened to perform differential pressure starting (z1), the third outlet 134 may be closed for the refrigerant pump-down operation.

The second blower fan 34 and the third blower fan 44 may perform the blowing operation for defrosting the inner portion of the second storage compartment 30 and the inner portion of the third storage compartment 40 while the refrigerant pump-down operation is performed. The blowing operations of the second blower fan 34 and the third blower fan 44 may be performed for approximately five minutes, for example.

The refrigerant pump-down operation may be omitted in accordance with embodiments.

Figure 15B:
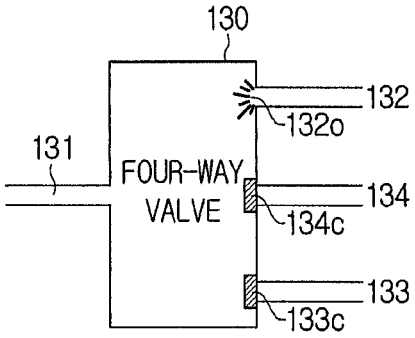

When an eleventh time t11 is reached after the refrigerant pump-down operation has begun, the first outlet 132 may be opened as illustrated in FIG. 15B (132*o*). When the first outlet 132 is opened, the refrigerant may be introduced into the first heat exchanger 200 connected to the first outlet 132. The first heat exchanger 200 may generate the cold air supplied to the first storage compartment 20 that operates as the refrigerator compartment R.

When a predetermined amount of time has elapsed after the first outlet 132 is opened, or as the first outlet 132 is opened, the first blower fan 24 configured at the inner portion of the first storage compartment 20 may begin operating. The cold air generated in the first heat exchanger 200 flows to the first storage compartment 20 in accordance with the operation of the first blower fan 24.

Meanwhile, even after the first outlet 132 is opened, the second blower fan 34 and the third blower fan 44 may continue to perform the blowing operations for defrosting the second storage compartment 30 and the third storage compartment 40, and may stop operating after a predetermined amount of time elapsed.

Figure 15C:
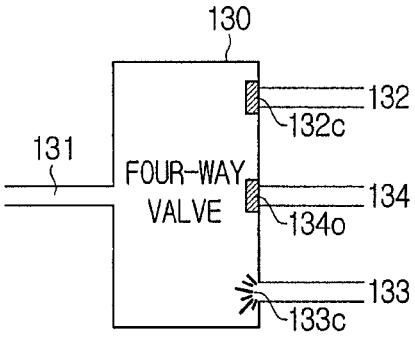

As illustrated in FIGS. 14 and 15C, when a twelfth time t12 is reached, the first outlet 132 may be closed (132*c*) and the second outlet 133 may be opened (133*o*) such that the refrigerant is discharged through the second outlet 133.

When the second outlet 133 is opened as illustrated above, the refrigerant may be transferred to the second heat exchanger 300 and the third heat exchanger 400 serially connected to the second heat exchanger 300. Accordingly, cold air is generated at the surroundings of the second heat exchanger 300 and the third heat exchanger 400.

As the second outlet 133 is opened, or when a predetermined amount of time has elapsed after the second outlet 133 is opened, the second blower fan 34 and the third blower fan 44 configured in the second storage compartment 30 and the third storage compartment 40, respectively, may begin operating. The cold air generated in the second heat exchanger 300 and the third heat exchanger 400 in accordance with the operations of the second blower fan 34 and the third blower fan 44 flow into the second storage compartment 30 and the third storage compartment 40, and the air temperatures of the second storage compartment 30 and the third storage compartment 40 are lowered.

Meanwhile, the first blower fan 24 may continuously operate until a thirteenth time t13 for natural defrosting even after the flow of the refrigerant to the first heat exchanger 200 is stopped.

Figure 15D:
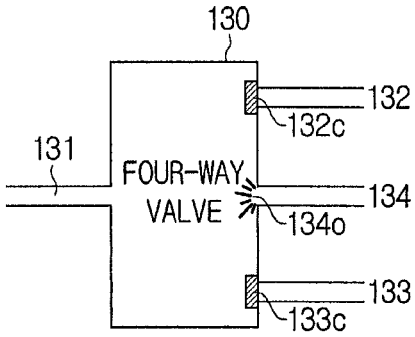

When a fourteenth time t14 is reached, the second outlet 133 may be closed (133*c*) and the third outlet 134 may be opened (134*o*) as illustrated in FIG. 15D. Due to the closing of the second outlet 133 and the opening of the third outlet 134, the refrigerant may be transferred only to the third heat exchanger 400. When the second outlet 133 is closed and the third outlet 134 is opened as mentioned above, the second blower fan 34 may stop operating while the third blower fan 44 may keep operating. Accordingly, cold air is continuously supplied to the third storage compartment 40 and the air temperature of the third storage compartment 40 is further lowered.

Figure 15E:
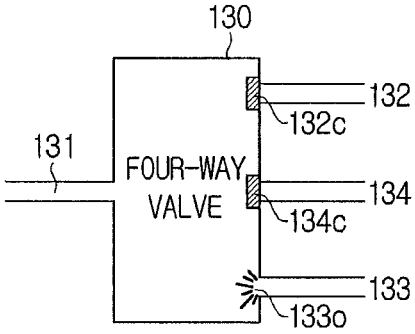

When a fifteenth time t15 is reached, the second outlet 133 may be opened again (133*o*) and the third outlet 134 may be closed again (134*c*) as illustrated in FIG. 15E. Then, the refrigerant is transferred to both of the second heat exchanger 300 and the third heat exchanger 400, and cold air is generated at the surroundings of the second heat exchanger 300 and the third heat exchanger 400. In this case, as the refrigerant flows to the second heat exchanger 300, the second blower fan 34 performs the blowing operation again.

Figure 15F:
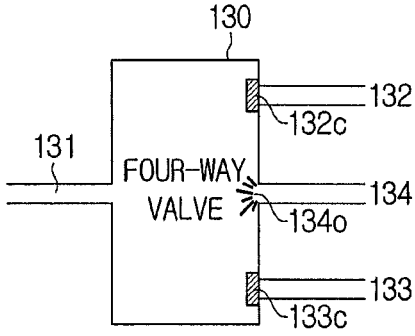

When a sixteenth time t16 is reached, the second outlet 133 may be closed again (133*c*) and the third outlet 134 may be opened again (134*o*) as illustrated in FIG. 15F. Accordingly, the supply of the refrigerant to the second heat exchanger 300 is stopped and the refrigerant may be supplied only to the third heat exchanger 400. Due to the stopping of the refrigerant supply to the second heat exchanger 300, the blowing operation of the second blower fan 34 is also stopped.

When a seventeenth time t17 is reached, the third outlet 134 may be closed again as illustrated in FIG. 15A, and accordingly, all of the outlets 132, 133, and 134 may be closed.

In this case, the second blower fan 34 may begin the blowing operation again for naturally defrosting the second storage compartment 30 and the third storage compartment 40, and the third blower fan 44 may keep performing the blowing operation. The second blower fan 34 may stop operating at an eighteenth time t18, and the third blower fan 44 may stop operating at a nineteenth time t19.

When a twentieth time t20 is reached, the third outlet 134 may be opened again in accordance with whether the refrigerator 10 performs differential pressure starting. For example, when the refrigerator 10 does not perform differential pressure starting, the third outlet 134 is opened, and when the refrigerator 10 performs differential pressure starting, the third outlet 134 remains closed.

In FIG. 14, the eleventh time t11 to the twentieth time t20 may be fixed in accordance with predetermined settings, or may be changeable in accordance with conditions. In this case, the eleventh time t11 to the twentieth time t20 may be changed in accordance with the air temperature of the inner portion of the first storage compartment 20, or may be changed in accordance with the predetermined set temperature. The tenth time t10 may also be fixed or changeable.

Hereinafter, refrigerators according to fourth to seventh embodiments will be described with reference to FIGS. 16 to 19.

Figure 16:
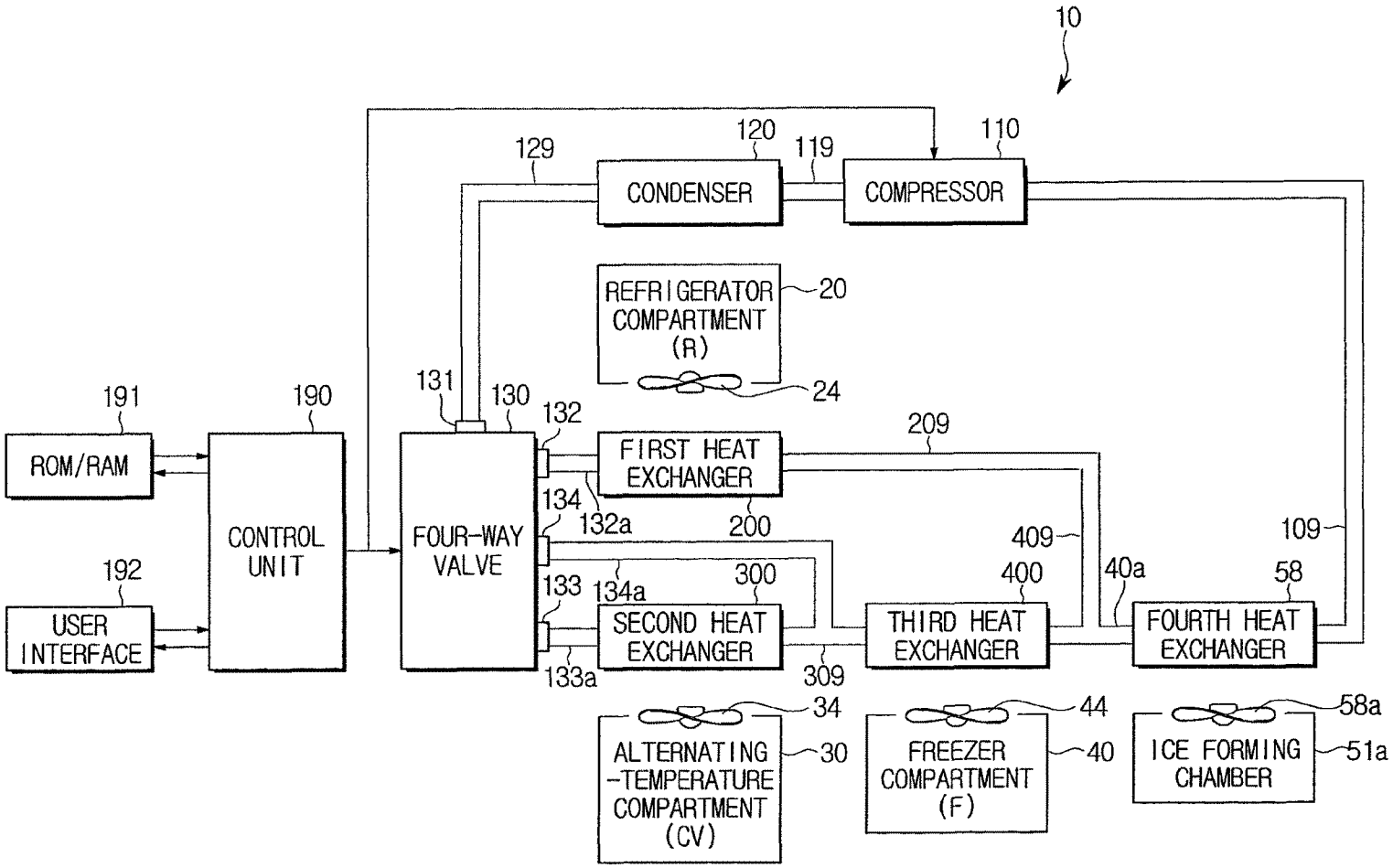
FIG. 16 is a view illustrating a refrigerator according to a fourth embodiment.

FIG. 16 is a view illustrating a refrigerator according to the fourth embodiment.

According to the fourth embodiment of the refrigerator 10 illustrated in FIG. 16, the refrigerator 10 may include the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, the control unit 190, the storage device 191, and a fourth heat exchanger 58. Since the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, and the storage device 191 have been described already, the description thereof will be omitted.

The fourth heat exchanger 58 may be configured to have one end serially connected to the first heat exchanger 200 and the other end serially connected to the second heat exchanger 300 and the third heat exchanger 400 as illustrated in FIG. 16.

Specifically, the fourth heat exchanger 58 may be connected to the first heat exchanger 200 and the third heat exchanger 400 to receive the refrigerant discharged from the first heat exchanger 200 or the third heat exchanger 400. The third heat exchanger 400 and the fourth heat exchanger 58 may be connected via the sixth refrigerant passage 409, and the fourth refrigerant passage 209 extending from the first heat exchanger 200 may be connected to the sixth refrigerant passage 409 such that the refrigerant discharged from the first heat exchanger 200 is transferred to the fourth heat exchanger 58 via the fourth refrigerant passage 209 and the sixth refrigerant passage 409.

Since the refrigerant is transferred to the first heat exchanger 200 when the first outlet 132 is opened, the refrigerant is transferred to the second heat exchanger 300 and the third heat exchanger 400 when the second outlet 133 is opened, and the refrigerant is transferred to the third heat exchanger 400 when the third outlet 134 is opened, the refrigerant passes through the fourth heat exchanger 58 regardless of which of the outlets 132, 133, and 134 are opened. Consequently, when the refrigerant circulates, cold air may be always generated at the surroundings of the fourth heat exchanger 58.

According to an embodiment, the fourth heat exchanger 58 may be a heat exchanger used in the ice making device 51, and the cold air generated in the fourth heat exchanger 58 may be transferred into the ice making chamber 51*a* by the blower fan 58*a* configured at the ice making device 51. As mentioned above, since cold air may be generated at the surroundings of the fourth heat exchanger 58 regardless of which of the outlets 132, 133, and 134 are opened, the air in the ice making chamber 51*a* may be always cooled regardless of temperature control of other storage compartments 20, 30, and 40.

The refrigerant discharged from the fourth heat exchanger 58 may be transferred to the compressor 110 via the compressor refrigerant introduction passage 109.

Figure 17:
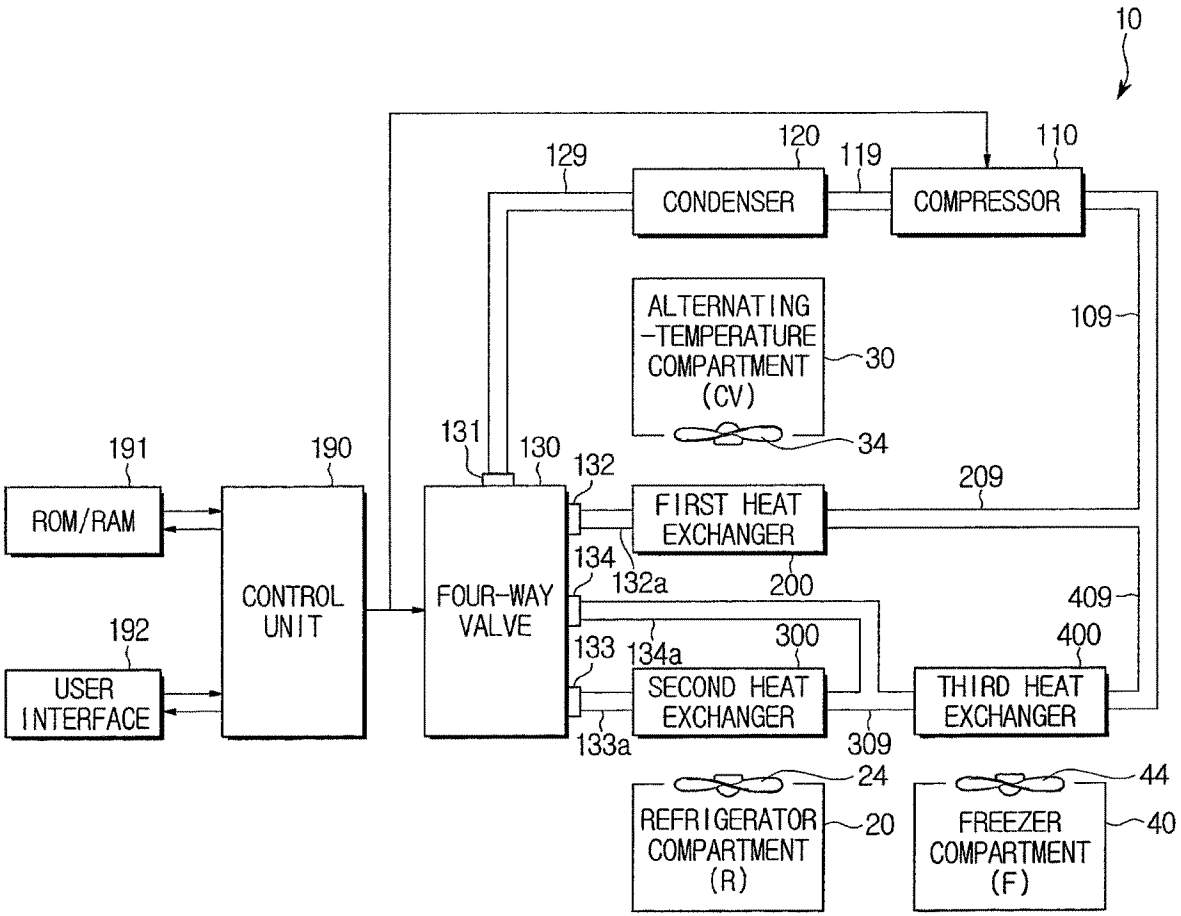
FIG. 17 is a view illustrating a refrigerator according to a fifth embodiment.

FIG. 17 is a view illustrating a refrigerator according to the fifth embodiment.

According to the fifth embodiment of the refrigerator 10 illustrated in FIG. 17, the refrigerator 10 may include the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, the control unit 190, and the storage device 191. Since the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, and the storage device 191 have been described already, the description thereof will be omitted.

Referring to FIG. 17, the first storage compartment 20 corresponding to the first heat exchanger 200 may be used as the alternating-temperature compartment CV, the second storage compartment 30 corresponding to the second heat exchanger 300 may be used as the refrigerator compartment R, and the third storage compartment 40 corresponding to the third heat exchanger 400 may be used as the freezer compartment F. In this case, the second heat exchanger 300 corresponding to the refrigerator compartment R and the third heat exchanger 400 corresponding to the freezer compartment F may be serially connected, and the first heat exchanger 200 corresponding to the alternating-temperature compartment CV may be connected to the second heat exchanger 300 and the third heat exchanger 400 in parallel.

In this case, the air of the freezer compartment F may be cooled together with the air of the refrigerator compartment R or may be cooled independently of the air of the refrigerator compartment R. The air of the alternating-temperature compartment CV may be cooled separately from the air of the refrigerator compartment R and the air of the freezer compartment F. Also, the air of the refrigerator compartment R may be cooled together with the air of the freezer compartment F.

In accordance with embodiments, the control unit 190 may first open the second outlet 133 connected to the second heat exchanger 300 used as the refrigerator compartment R among the outlets 132, 133, and 134 configured at the four-way valve 130 to first lower the inner temperatures of the refrigerator compartment R and the freezer compartment F. Also, the control unit 190 may open the first outlet 132 or the third outlet 134 after a predetermined amount of time has elapsed or in accordance with inner temperatures of the heat exchangers 200, 300, and 400 to make the refrigerant flow only to the first heat exchanger 200 or the third heat exchanger 400 such that the air in the alternating-temperature compartment CV or the air in the freezer compartment F may be individually and independently cooled.

As mentioned above, the second outlet 133, the first outlet 132, and the third outlet 134 may be sequentially opened, or the first outlet 132 and the third outlet 134 may be alternately opened after the open second outlet 133 is closed.

Figure 18:
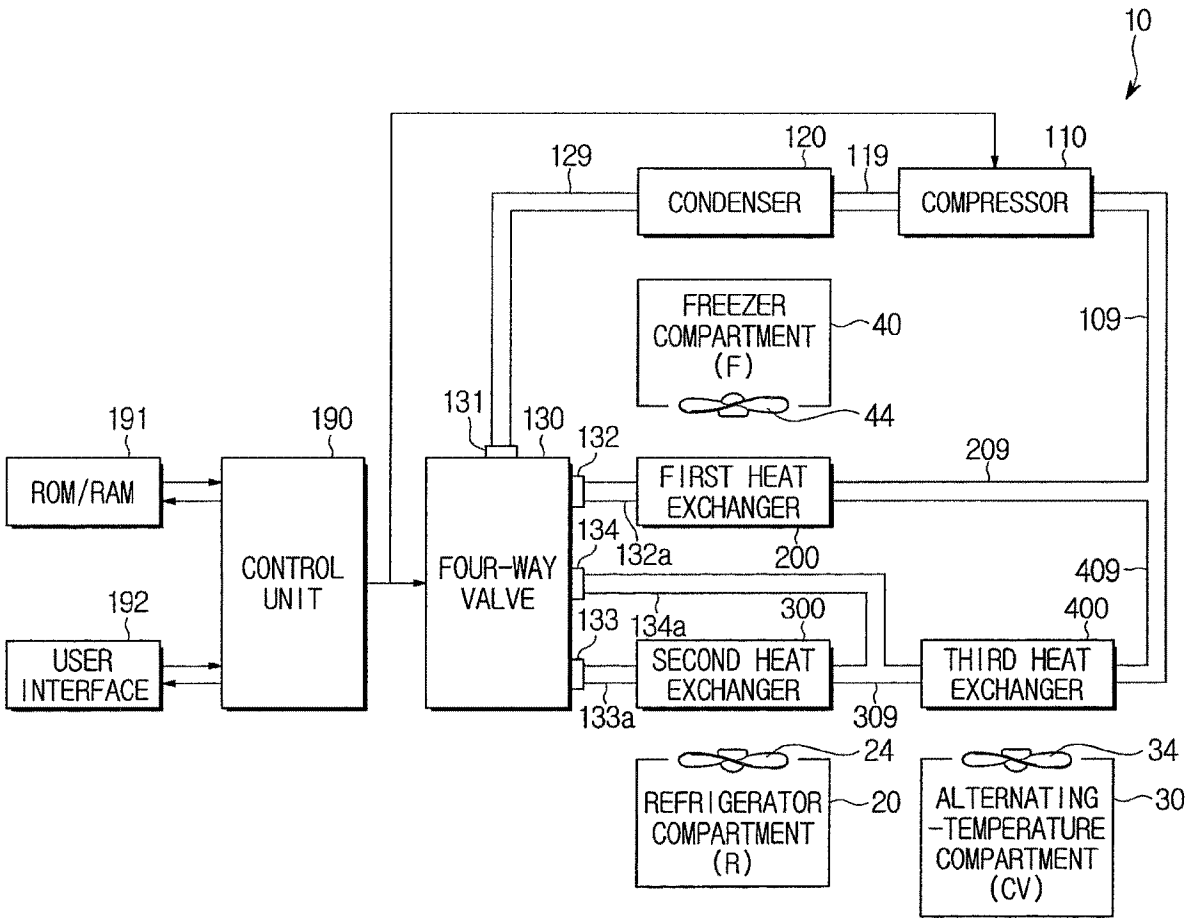
FIG. 18 is a view illustrating a refrigerator according to a sixth embodiment.

FIG. 18 is a view illustrating a refrigerator according to the sixth embodiment.

According to the sixth embodiment of the refrigerator 10 illustrated in FIG. 18, the refrigerator 10 may include the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, the control unit 190, and the storage device 191. Here, since the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, and the storage device 191 have been described already, the description thereof will be omitted.

Referring to FIG. 18, the first storage compartment 20 corresponding to the first heat exchanger 200 may be used as the freezer compartment F, the second storage compartment 30 corresponding to the second heat exchanger 300 may be used as the refrigerator compartment R, and the third storage compartment 40 corresponding to the third heat exchanger 400 may be used as the alternating-temperature compartment CV. In this case, the second heat exchanger 300 corresponding to the refrigerator compartment R and the third heat exchanger 400 corresponding to the alternating-temperature compartment CV may be serially connected to each other, and the first heat exchanger 200 corresponding to the freezer compartment F may be connected to the second heat exchanger 300 and the third heat exchanger 400 in parallel.

In this case, the air of the alternating-temperature compartment CV may be cooled together with the air of the refrigerator compartment R or may be cooled independently of the air of the refrigerator compartment R. The air of the freezer compartment F may be cooled separately from the air of the refrigerator compartment R and the air of the alternating-temperature compartment CV. Also, the air of the refrigerator compartment R may be cooled together with the air of the alternating-temperature compartment CV.

In accordance with embodiments, the control unit 190 may first open the second outlet 133 connected to the second heat exchanger 300 used as the refrigerator compartment R among the outlets 132, 133, and 134 configured at the four-way valve 130 to first lower the inner temperatures of the refrigerator compartment R and the alternating-temperature compartment CV. Also, the control unit 190 may open the first outlet 132 or the third outlet 134 after a predetermined amount of time has elapsed or in accordance with inner temperatures of the heat exchangers 200, 300, and 400 to make the refrigerant flow only to the first heat exchanger 200 or the third heat exchanger 400. Accordingly, the air in the freezer compartment F or the air in the alternating-temperature compartment CV may be individually and independently cooled.

As mentioned above, the second outlet 133, the first outlet 132, and the third outlet 134 may be sequentially opened. Also, the first outlet 132 and the third outlet 134 may be alternately opened after the second outlet 133 is closed.

Figure 19:
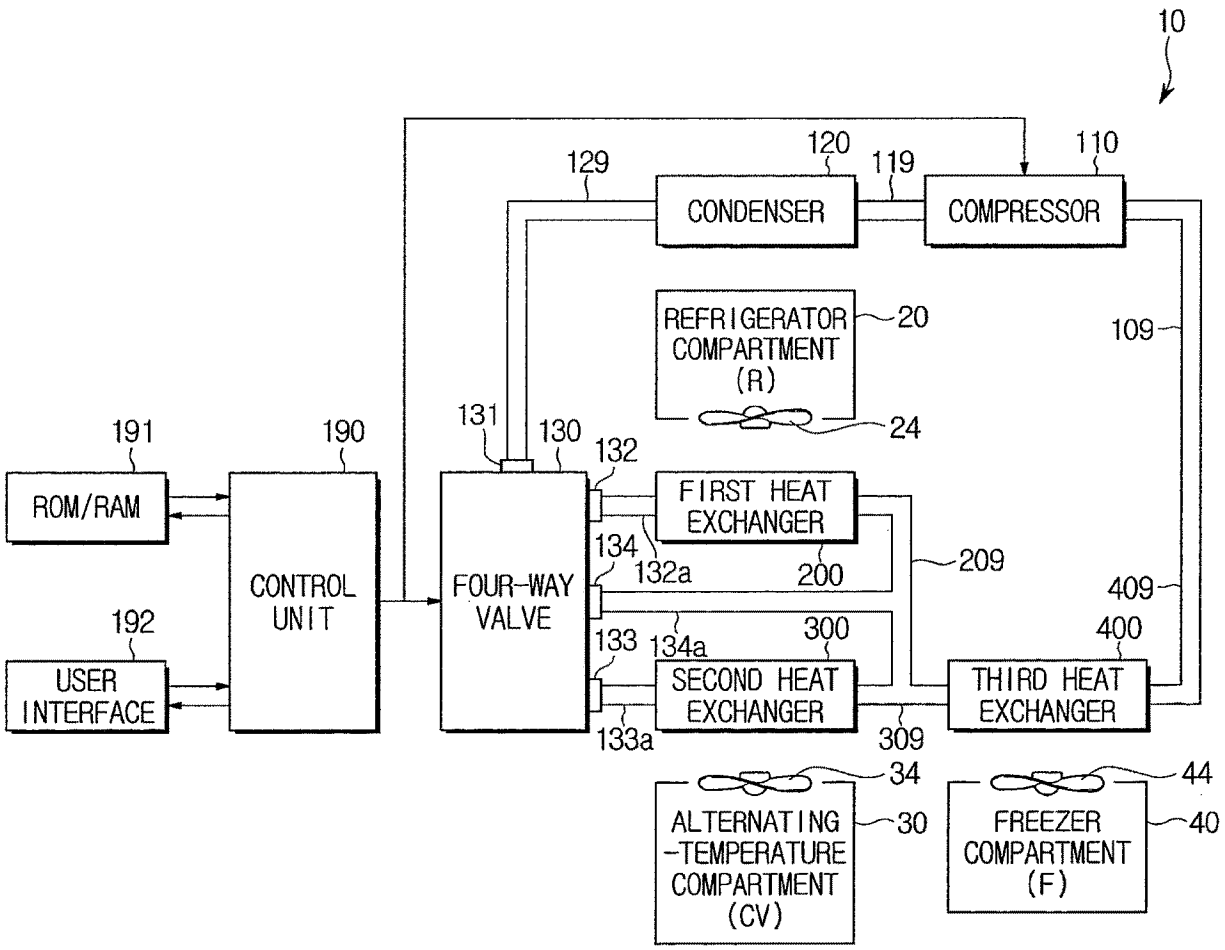
FIG. 19 is a view illustrating a refrigerator according to a seventh embodiment.

FIG. 19 is a view illustrating a refrigerator according to the seventh embodiment.

According to the seventh embodiment of the refrigerator 10 illustrated in FIG. 19, the refrigerator 10 may include the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, the control unit 190, and the storage device 191. Here, since the storage compartments 20, 30, and 40, the blower fans 24, 34, and 44, the compressor 110, the condenser 120, the four-way valve 130, the first heat exchanger 200, the second heat exchanger 300, the third heat exchanger 400, the refrigerant passages 109, 119, 129, 132*a*, 133*a*, 134*a*, 209, 309, and 409 to connect the above, and the storage device 191 have been described already, the description thereof will be omitted.

Referring to FIG. 19, the first storage compartment 20 corresponding to the first heat exchanger 200 may be used as the refrigerator compartment R, the second storage compartment 30 corresponding to the second heat exchanger 300 may be used as the alternating-temperature compartment CV, and the third storage compartment 40 corresponding to the third heat exchanger 400 may be used as the freezer compartment F. Also, the first outlet 132 of the four-way valve 130 may be connected to the first heat exchanger 200, the second outlet 133 is connected to the second heat exchanger 300, and the third outlet 134 may be connected to the third heat exchanger 400.

According to the embodiment, the fourth refrigerant passage 209 may be connected to the fifth refrigerant passage 309 that connects the second heat exchanger 300 and the third heat exchanger 400, and the refrigerant discharged from the first heat exchanger 200 may be transferred to the third heat exchanger 400 via the fourth refrigerant passage 209 and the fifth refrigerant passage 309. In other words, the first heat exchanger 200 may be serially connected to the third heat exchanger 400. Meanwhile, in this case, the second heat exchanger 300 may be configured to be connected to the first heat exchanger 200 in parallel, and may be serially connected to the third heat exchanger 400 via the fifth refrigerant passage 309.

When disposed as above, both of the refrigerant discharged after being introduced into the first heat exchanger 200 and the refrigerant discharged after being introduced into the second heat exchanger 300 may be introduced into the third heat exchanger 400 such that the refrigerant may be transferred to the third heat exchanger 400 regardless of which of the first outlet 132, the second outlet 133, and the third inlet 134 are opened, and the air temperature in the third heat exchanger 400 may be further lowered separately from the refrigerator compartment R or the alternating-temperature compartment CV. Meanwhile, the alternating-temperature compartment CV may be cooled independently of the refrigerator compartment R, and the refrigerator compartment R may also be cooled independently of the alternating-temperature compartment CV.

Meanwhile, in accordance with embodiments, the fourth refrigerant passage 209 may also be connected to the third refrigerant passage 134*a* extending from the third outlet 134 of the four-way valve 130 as illustrated in FIG. 19. Of course, the fourth refrigerant passage 209 may not be connected to the third refrigerant passage 134*a* but connected only to the fourth refrigerant passage 209.

The control unit 190 may first open the first outlet 132 connected to the first heat exchanger 200 used as the refrigerator compartment R among the outlets 132, 133, and 134 configured at the four-way valve 130 to first lower the inner temperatures of the refrigerator compartment R and the freezer compartment F. Also, the control unit 190 may sequentially open the second outlet 133 and the third outlet 134 after a predetermined amount of time has elapsed or in accordance with inner temperatures of the predetermined heat exchangers 200, 300, and 400, or alternately open the second outlet 133 and the third outlet 134 to simultaneously cool the alternating-temperature compartment CV and the freezer compartment F or cool only the freezer compartment F.

In the above, although several embodiments of the refrigerator 10 including the three storage compartments 20, 30, and 40 have been described, the number of storage compartments configured in the refrigerator 10 is not limited to three. In accordance with embodiments, four or more storage compartments may be configured in the refrigerator 10. The refrigerator according to the first to seventh embodiments may be applied in the same way or applied with partial modifications even when four or more storage compartments are configured therein.

According to the above-mentioned refrigerator, independent cooling of at least one storage compartment may be effectively performed in a refrigerator including a plurality of storage compartments.

According to the above-mentioned refrigerator, parts required for realizing a cooling cycle are reduced or integrated to improve a structure related to the cooling cycle such that the complexity of the apparatus is reduced, thereby reducing a manufacturing cost of the refrigerator.

According to the above-mentioned refrigerator, at least two storage compartments may be simultaneously cooled, thereby easily dealing with an overload of the refrigerator even using a lower-capacity compressor.

In addition, according to the above-mentioned refrigerator, a heat transfer area of an evaporator may be relatively increased, thereby improving energy efficiency of the refrigerator when at least two storage compartments are simultaneously cooled.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising a first storage compartment, a second storage compartment, a third storage compartment and an ice forming chamber, the refrigerator comprising:

a four-way valve including an inlet through which refrigerant is introduced and a plurality of outlets to discharge the refrigerant, and configured to open at least one of the plurality of outlets;

a first heat exchanger;

a second heat exchanger;

a third heat exchanger; and a fourth heat exchanger, wherein the first heat exchanger is directly connected to a first outlet of the plurality of outlets via a first refrigerant passage to adjust a temperature of the first storage compartment, the second heat exchanger is directly connected to a second outlet of the plurality of outlets via a second refrigerant passage to adjust a temperature of the second storage compartment, the third heat exchanger is directly connected to the second heat exchanger and a third outlet of the plurality of outlets, wherein a third refrigerant passage directly interconnects the third outlet and a fifth refrigerant passage, and the fifth refrigerant passage directly interconnects the second heat exchanger and the third heat exchanger, to receive refrigerant from at least one of the second heat exchanger and the third outlet to adjust a temperature of the third storage compartment, the fourth heat exchanger is connected to the first heat exchanger via a fourth refrigerant passage to receive refrigerant from the first heat exchanger, and a sixth refrigerant passage directly interconnects the fourth refrigerant passage and a seventh refrigerant passage, wherein the seventh refrigerant passage directly interconnects the third heat exchanger and the fourth heat exchanger, and the fourth exchanger exclusively receives refrigerant via the seventh refrigerant passage.

2. The refrigerator according to claim 1, wherein a temperature of at least one of the first storage compartment, the second storage compartment, and the third storage compartment is independently adjustable.

3. The refrigerator according to claim 1, wherein the first heat exchanger and the second heat exchanger are connected to each other in parallel.

4. The refrigerator according to claim 1, wherein the second heat exchanger and the third heat exchanger are serially connected.

5. The refrigerator according to claim 1, wherein at least one of the first storage compartment, the second storage compartment, and the third storage compartment comprises an alternating-temperature compartment in which a temperature is adjustable within a predetermined range.

6. The refrigerator according to claim 5, wherein at least one of the first storage compartment, the second storage compartment, and the third storage compartment comprises at least one of a refrigerator compartment in which a temperature is adjusted in accordance with a predetermined set temperature and a freezer compartment in which a temperature is adjusted to be lower than the temperature of the refrigerator compartment.

7. The refrigerator according to claim 6, wherein the first storage compartment is the refrigerator compartment, the second storage compartment is the alternating-temperature compartment, and the third storage compartment is the freezer compartment.

8. The refrigerator according to claim 1, wherein the first storage compartment is a freezer compartment, the second storage compartment is a refrigerator compartment, and the third storage compartment is an alternating-temperature compartment.

9. The refrigerator according to claim 1, wherein the first storage compartment is an alternating-temperature compartment, the second storage compartment is a refrigerator compartment, and the third storage compartment is a freezer compartment.

10. The refrigerator according to claim 1, further comprising a control unit configured to control the first outlet of the four-way valve to be opened to transfer refrigerant to the first heat exchanger, configured to control the second outlet of the four-way valve to be opened to transfer refrigerant to the second heat exchanger and the third heat exchanger connected to the second heat exchanger, or configured to control the third outlet of the four-way valve to be opened to transfer refrigerant to the third heat exchanger.

11. The refrigerator according to claim 10, further comprising a storage compartment temperature measurement unit configured to measure an air temperature of an inner portion of at least one storage compartment of the first storage compartment, the second storage compartment, and the third storage compartment.

12. The refrigerator according to claim 11, wherein the control unit opens at least one of the first outlet, the second outlet, and the third outlet in accordance with a temperature of at least one storage compartment of the first storage compartment, the second storage compartment, and the third storage compartment received from the storage compartment temperature measurement unit.

13. The refrigerator according to claim 12, wherein the control unit opens the first outlet, and controls the first outlet to be closed and the second outlet to be opened when the temperature of the first storage compartment has reached a set temperature.

14. The refrigerator according to claim 10, wherein the control unit opens at least one of the first outlet, the second outlet, and the third outlet in accordance with time elapsed.

15. The refrigerator according to claim 10, wherein the control unit controls the first outlet, the second outlet, and the third outlet to be opened sequentially.

16. The refrigerator according to claim 10, wherein the control unit controls at least two of the first outlet, the second outlet, and the third outlet to be opened alternately to adjust inner temperatures of the storage compartments corresponding to the at least two outlets.

17. The refrigerator according to claim 16, wherein:

among the first storage compartment, the second storage compartment, and the third storage compartment, at least one is a refrigerator compartment, another one is a freezer compartment, and the remaining one is an alternating-temperature compartment; and the control unit opens an outlet connected to the refrigerator compartment, and alternately opens an outlet connected to the freezer compartment and an outlet connected to the alternating-temperature compartment when the outlet connected to the refrigerator compartment is closed.

18. The refrigerator according to claim 1, further comprising:

one compressor configured to suction and discharge refrigerant discharged from at least one of the first heat exchanger, the second heat exchanger, and the third heat exchanger; and a condenser configured to liquefy the refrigerant discharged from the compressor to supply the refrigerant to the four-way valve.

19. The refrigerator according to claim 1, wherein the fourth heat exchanger adjusts a temperature of the ice forming chamber.

20. A refrigerator comprising:

a first storage compartment;

a second storage compartment;

a third storage compartment;

an ice forming chamber;

a four-way valve including an inlet through which refrigerant is introduced and a plurality of outlets to discharge the refrigerant, and configured to open at least one of the plurality of outlets;

a first heat exchanger;

a second heat exchanger;

a third heat exchanger; and a fourth heat exchanger, wherein the first heat exchanger is directly connected to a first outlet of the plurality of outlets via a first refrigerant passage, to thereby adjust a temperature of the first storage compartment, the second heat exchanger is directly connected to a second outlet of the plurality of outlets via a second refrigerant passage, to thereby adjust a temperature of the second storage compartment, the third heat exchanger is directly connected to the second heat exchanger and a third outlet of the plurality of outlets, wherein a third refrigerant passage directly interconnects the third outlet and a fifth refrigerant passage, and the fifth refrigerant passage directly interconnects the second heat exchanger and the third heat exchanger, to receive refrigerant from at least one of the second heat exchanger and the third outlet to thereby adjust a temperature of the third storage compartment, the fourth heat exchanger is connected to the first heat exchanger via a fourth refrigerant passage to receive refrigerant from the first heat exchanger, to thereby adjust a temperature of the ice forming chamber, and a sixth refrigerant passage directly interconnects the fourth refrigerant passage and a seventh refrigerant passage, wherein the seventh refrigerant passage directly interconnects the third heat exchanger and the fourth heat exchanger, and the fourth exchanger exclusively receives refrigerant via the seventh refrigerant passage.

* * * * *